United States Patent [19]

Hams

[11] Patent Number: 4,577,848

[45] Date of Patent: Mar. 25, 1986

[54] METHOD AND APPARATUS FOR CONTROLLING THE ACTUATION OF GRIPPER ARMS

[75] Inventor: Kenneth A. Hams, Easton, Pa.

[73] Assignee: Bell & Howell Company, Allentown, Pa.

[21] Appl. No.: 754,204

[22] Filed: Jul. 11, 1985

Related U.S. Application Data

[63] Continuation of Ser. No. 648,407, Sep. 7, 1984, abandoned.

[51] Int. Cl.[4] ..... B65H 5/30

[52] U.S. Cl. ..... 270/55; 270/58; 53/266 A

[58] Field of Search ..... 270/54–58; 271/85, 263, 268; 414/226, 730, 732; 53/266 A

[56] References Cited

U.S. PATENT DOCUMENTS

| | | | |
|---|---|---|---|
| 3,606,728 | 9/1971 | Sather et al. | 270/57 |
| 3,744,787 | 7/1973 | Morrison | 270/56 |
| 3,885,780 | 5/1975 | Morrison | 270/56 |
| 3,965,644 | 6/1976 | Stocker | 270/58 |
| 4,039,180 | 8/1977 | Stocker | 271/10 |
| 4,484,733 | 11/1984 | Loos et al. | 270/54 |
| 4,517,650 | 5/1985 | Gomes et al. | 270/58 |
| 4,525,788 | 6/1985 | Gottlieb et al. | 270/58 |

*Primary Examiner*—E. H. Eickholt

*Attorney, Agent, or Firm*—Griffin, Branigan & Butler

[57] ABSTRACT

An insertion machine has a plurality of gripper arms (16), each gripper arm including jaw members (24,26) between which inserts are engaged and from which engaged inserts are released in precise placement upon a transport means (18). Each jaw (26) is actuated by actuating means (28) acting through linkage means (30) to perform the engagement and release operations. Upon insert engagement the activation of the actuating means (28) is controlled to be dependent upon the operating speed of the insertion machine. Upon insert release the activation of each actuating means (28) is controlled so that release is delayed by three release time delay components. A first release time delay component is occasioned by a master presettable release delay means (322) which delays the release operation actuating means (28) of all insert stations in accordance with a preset input value. A second release time delay component is dependent upon the operating speed of the insertion machine. A third release time delay component, which varies from insert station to insert station depending on insert size, is occasioned by individual station presettable release delay means (338) which delays the release operation of actuating means (28) for its insert station.

13 Claims, 17 Drawing Figures

METHOD AND APPARATUS FOR CONTROLLING THE ACTUATION OF GRIPPER ARMS

This is a continuation of application Ser. No. 06/648,407, filed Sept. 7, 1984, and now abandoned.

BACKGROUND OF THE INVENTION

1. Field of the Invention

This invention pertains to the control of gripper arms, and particularly the control of gripper arms suitable for use with insertion machines and the like.

2. Prior Art and Other Considerations

Gripper arms have long been used with insertion machines of the type depicted in U.S. Pat. No. 2,325,455 to A. H. Williams which is incorporated herein by reference. Prior art gripper arms typically each have fixed and movable jaw members. The fixed jaw member is usually integral with the gripper arm while the movable jaw is selectively operated so that articles, such as documents or inserts, can be engaged between and released from the two jaws.

Prior art gripper arms have traditionally been mounted on two elongated shafts which extend above and along an insert transport track or raceway. The first or upper shaft, which oscillates once per machine cycle, has an upper portion of the gripper arm keyed thereto so that the gripper arm oscillates toward and away from a corresponding insertion supply station in timed relationship with the other operations occuring at the station. The second shaft also oscillates once during each machine cycle to actuate the movable jaw member into and out of engagement with the fixed jaw member in timed relationship with the oscillation of the gripper arm about the first shaft and with the rest of the machine. A cam keyed to the second shaft acts upon a connecting rod which in turn moves the movable jaw member away from the fixed jaw member against the action of a tension spring. The jaws are held apart in this manner until the gripper arm is oscillated toward the corresponding insertion station whereat the movable jaw is positioned above and the fixed jaw is positioned below an insert. The second shaft then oscillates to close the movable jaw against the fixed jaw to engage and grip the insert. The first shaft thereupon swings away from the insert station, pulling the selected insert therefrom in a direction toward the insert track. Over the insert track the second shaft is oscillated to move the movable jaw member away from the fixed jaw and thereby release the insert, permitting the insert to fall onto the transport track.

Although only one gripper arm structure has been described above, it should be understood that a plurality of gripper arms are provided with an insertion machine, each gripper arm being positioned in relation to corresponding insert stations linearly arranged along an insert track. Insertion machines of this type described above can operate through a range of speeds. An operator may at a lower end of the operational speed range "step" or "jog" the machine through a machine cycle at a very slow speed as is useful in the case of setting up the machine with new material. At high operational speeds the insertion machine may operate at a rate in the neighborhood of 10,000 cycles per hour.

In setting up an insertion machine, the operator must be cognizant of the fact that each insert must be released at a precise location along the insert track, usually within ⅛ inch of a specified precise location. In this respect, each insert must be released so that the insert contacts both of a pair of pusher pins that index the insert down the insert track. The time delay associated with the actuation of the movable jaw member thus becomes a factor in determining where on the insert track the insert will be released.

If the delay time in actuating the movable jaw member is constant regardless of the operational speed of the machine, significant error can occur in placement of the insert on the insert track. For example, a delay of 20 to 25 milliseconds in actuating the movable jaw member when the insertion machine is operating at 10,000 cycles per hour results in the gripper arm travelling approximately one inch. Thus, a give magnitude of time delay in actuating the movable jaw member in the jog mode or at low speed is not suitable for higher operational speeds and can, when the machine is operated at higher speeds, result in significant misplacement of the insert on the insert track. In this respect U.S. patent application Ser. No. 06/648,391, filed Sept. 7, 1984 by Vandersyde et al., and incorporated herein by reference, addresses the foregoing problem by providing a solenoid actuated gripper arm wherein the magnitude of delay involved in actuating a movable jaw member is related to the operational speed of the insertion machine in conjunction with which the gripper arm is employed.

The operational speed of an insertion machine is but one factor which is pertinent to the timing of the actuation of gripper arm jaw members and hence the proper placement of inserts on an insert track. Another factor affecting the timing of the release of inserts at proper positions on the insert track is the size of the inserts. In this regard, it is desirous that each gripper arm release its inserts so that each insert will be contacted by both advancing pusher pins on the insert track. When the size of inserts vary from insert station to insert station, and when all the gripper arms associated with the insert stations along an insert track are actuated to release their inserts at the same point in a machine cycle, an insert of an odd size may be released and deposited on the insert track in a manner whereby it cannot contact both of its pusher pins. The prior art manner of essentially simultaneously releasing inserts from the various stations regardless of insert size can ultimately result in skewed insert placement, which in turn can cause jamming on the insert track.

The insert tracks or raceways of many conventional insertion machines have side rails or the like which extend on opposite sides of the insert track and substantially along the length (i.e. the major dimension or direction of travel) of the insert track. In many insertion machines the positioning of one or both of these side rails is adjustable so that the distance separating the side rails can be selectively varied. In some insertion machines, for example, the side rail nearest from the row of insert stations can be moved through a displacement range of as much as four inches while the side rail furtherest the row of insert stations can be moved through a displacement range of as much as three-quarters of an inch. The selective adjustment of the side rails advantageously permits the insertion machine to accommodate on its insert track inserts of varying size. For example, if the size of the inserts vary from insert station to insert station, the side rails can be positionally adjusted sufficiently far apart so that the largest of the inserts at the various insert stations can be accommodated on the insert track.

In order to accommodate the very large size inserts that might be present at one of the insert stations, an operator typically first moves the side rail furtherest from the row of insert stations to its maximum displacement. If the insert track is still not wide enough the operator can then move the side rail nearest the row of insert stations closer to the insert stations to further broaden the insert track. While the selective positional adjustment of the side rails advantageously permits the insertion machine to accommodate on its insert track inserts of varying and especially large size, in a sense this adjustment capability is also a mixed blessing in that it further complicates the precise positioning of inserts on the insert track.

In view of the foregoing, it is an object of the present invention to provide method and apparatus for controlling the actuation of individual gripper arms of an insertion machine to take into consideration the fact that insert sizes may differ from insert station to insert station.

An advantage of the present invention is the provision of method and apparatus for simultaneously adjusting the timed actuation of a plurality of gripper arms of an insertion machine to take into consideration the selective positional adjustment of side rails bordering the insert track.

A further advantage of the present invention is the provision of method and apparatus whereby timing of insert release from each gripper arm can be individually adjusted.

Another advantage of the present invention is the provision of embodiments wherein the magnitude of delays involved in actuating movable jaw members is related to the operational speed of the insertion machine in conjunction with which gripper arms are employed.

Yet another advantage of the present invention is the provision of method and apparatus for fine tuning even during machine operation the insert release times of individual gripper arms of an insertion machine.

SUMMARY

An insertion machine has a plurality of gripper arms, each gripper arm including jaw members between which inserts are engaged and from which engaged inserts are released in precise placement upon a transport means. Each jaw is actuated by actuating means acting through linkage means to perform the engagement and release operations. Upon insert engagement the activation of the actuating means is controlled to be dependent upon the operating speed of the insertion machine. Upon insert release the activation of each actuating means is controlled so that release is delayed by three release time delay components. A first release time delay component is occasioned by a master presettable release delay means which delays the release operation actuating means of all insert stations in accordance with a preset input value. A second release time delay component is dependent upon the operating speed of the insertion machine. A third release time delay component, which varies from insert station to insert station depending on insert size, is occasioned by individual station presettable release delay means which delays the release operation of actuating means for its insert station.

The first release time delay component is useful whenever an insert station has such large inserts that a side rail nearest the row of insert stations is moved closer to the insert stations to widen an insert track upon which inserts are to be deposited. This first or master release delay component is implemented simultaneously for all gripper jaws at all insert stations by selecting an appropriate value corresponding to the delay component on a master release delay thumbwheel switch. The master release delay thumbwheel switch presets a presettable down counter. During insert engagement operation a master preset release delay circuit comprising the presettable down counter and its associated thumbwheel switch has no appreciable impact, i.e. occasions no delay component, but upon initiation of the insert release operation the master preset release delay circuit overrides further operation until the expiration of a period corresponding to its selected release delay component. The release delay component implemented by the master preset release delay circuit essentially corresponds to the period required by the presettable down counter to count down a number of encoder pulses equal to the value to which the counter was selectively preset by the master release delay thumbwheel switch.

The second release time delay component is implemented after the master preset release delay circuit has had an opportunity to implement its release delay component. The second release time delay component is essentially a function of the operating speed of the insertion machine. To implement this machine speed dependent release delay component a counter B counts trailing edges of encoder pulses and a counter A counts clock pulses which occur after trailing edges of encoder pulses. When it is determined that at the occurrence of a leading edge of an encoder pulse that the contents of counters A and B are equal, a flip-flop changes state in order to signal the end of the machine speed dependent release delay component. Similar operation occurs for implementing a machine speed dependent engagement delay component. The machine speed dependent delay components are uniformly applied to gripper jaw actuating means (solenoids) at all insert stations.

The third release time delay component is implemented upon the expiration of the machine speed dependent release delay component. The third or station preset release delay component is implemented individually with respect to each insert station in accordance with a selected value on each station's own station release delay thumbwheel switch. The station thumbwheel switch and a presettable shift register comprise for each station a station preset release delay circuit. The value selected on the station thumbwheel switch presets the shift register in accordance with the desired duration of the third release delay component. Implementation of this third release delay component involves the shifting of the contents of the preset pulses until shifting is completed. When a false signal appears at the output pin of the shift register, a driver transistor ceases electrical conduction to deactivate the actuating solenoid. Deactivation of the solenoid causes gripper jaw members to open whereby an insert is deposited on the insert track.

BRIEF DESCRIPTION OF THE DRAWINGS

The foregoing and other objects, features, and advantages of the invention will be apparent from the following more particular description of the preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
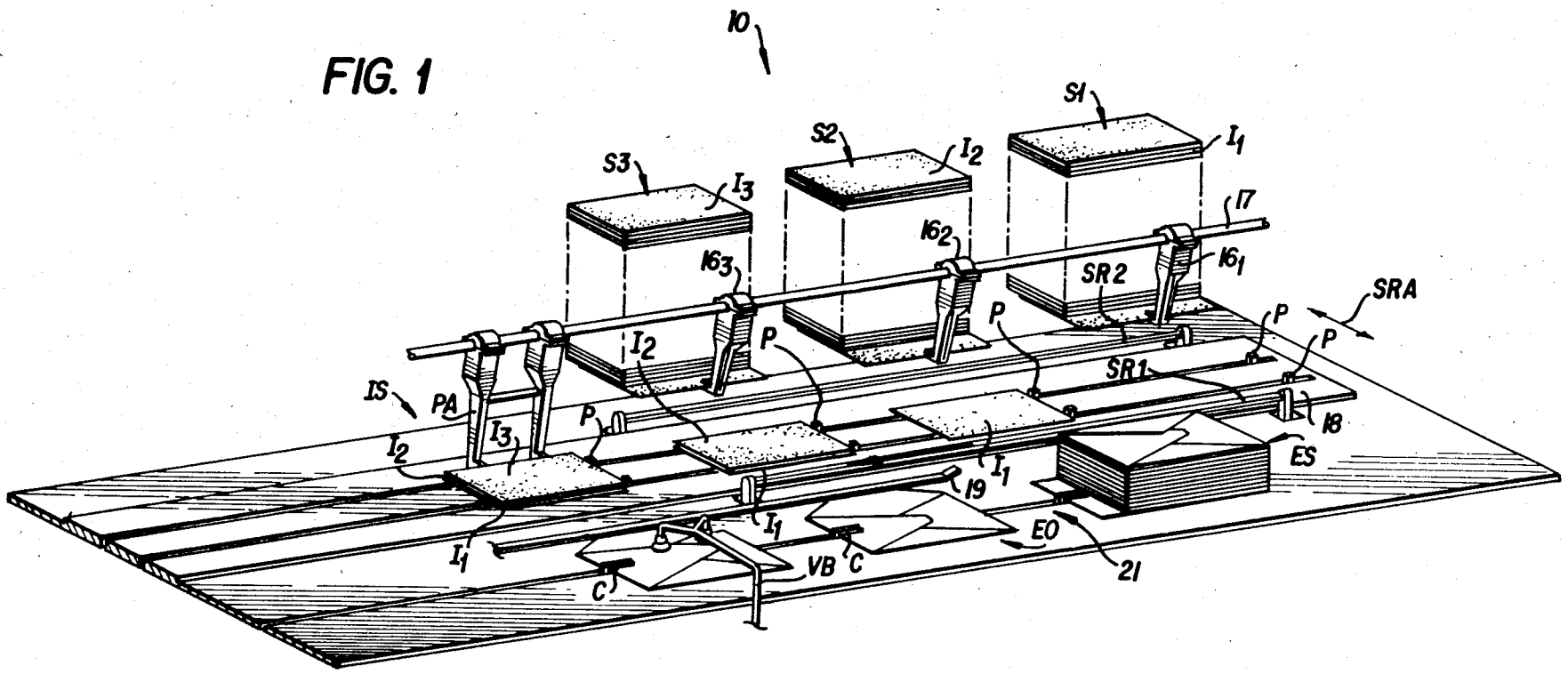
FIG. 1 is a diagrammatical view of portions of an insertion machine according to an embodiment of the invention.

Referring to FIG. 1, there is shown an insertion machine 10 which collects a plurality of inserts into a pile and transports that pile to an inserting station IS; conveys an open envelope to inserting station IS; and, then inserts the pile of inserts into the envelope. During steps unillustrated in FIG. 1 the insertion machine 10 later seals the envelope and processes the envelope for mailing. It will be appreciated that the operation of machine 10 is timed in accordance with a machine cycle. In this respect, an individual envelope requires several machine cycles to be processed. With the exception of a few initial or start-up machine cycles, a pile of inserts is inserted into an awaiting corresponding envelope at the end of each machine cycle.

In order for insertion machine 10 to collect a pile of inserts at inserting station IS, there are provided therein a plurality of insert stack stations or hoppers S1, S2, and S3 and a plurality of corresponding gripper arms $\mathbf{16}_1$, $\mathbf{16}_2$, and $\mathbf{16}_3$ each mounted to a shaft 17 which extends over an insert raceway 18. Insert station S1, gripper arm $\mathbf{16}_1$, and shaft 17 serve to withdraw one insert from the stack of inserts and drop that insert onto raceway 18. More particularly, insert station S1 holds a stack of inserts $I_1$ in a manner whereby the bottommost insert is separable from the rest of the stack. Gripper arm $\mathbf{16}_1$ is connected to shaft 17 which oscillates once during a portion of each machine cycle in order to rotate arm $\mathbf{16}_1$ toward and away from the stack of inserts. While rotating toward the stack, the jaws of gripper arm $\mathbf{16}_1$ are opened to allow the arm to engage the bottommost insert. When the shaft 17 stops moving arm $\mathbf{16}_1$ toward the stack, the jaws are closed to engage the bottommost insert. Shaft 17 then rotates gripper arm $\mathbf{16}_1$ away from the stack, thereby withdrawing the insert from the bottom of the stack. Gripper arm $\mathbf{16}_1$ then opens its jaws to release the insert which falls onto insert raceway 18. Thus, insert station S1, gripper arm $\mathbf{16}_1$, and shaft 17 cooperate to withdraw one insert from the stack and drop that insert onto raceway 18.

Insert raceway 18 includes a plurality of pairs of pusher pins P which are mounted on a pair of chains (not shown) which are periodically driven by machine 10. The chains are driven once during a portion of each machine cycle and move the pusher pins P to the next insert station. After the just-described dropping of an insert from station S1 onto raceway 18, for example, pins P push the insert to the vicinity of the insert station S2 and stop.

Insert raceway 18 is bordered by a first side rail SR1 which is furthest from the row of insert stations S1, S2, S3, and a second side rail SR2 which is nearest the row of insert stations. The side rails SR1 and SR2 are selectively movable in the direction of arrow SRA to selectively widen or narrow the insert raceway 18.

In view of the foregoing, it will be seen that insert station S1, gripper arm $\mathbf{16}_1$, shaft 17, and raceway 18 cooperate to withdraw one insert from the stack and convey that insert to station S2. It will be appreciated that for the embodiment shown one insert from station S1 is conveyed to station S2 each machine cycle.

Insert station S2, gripper arm $\mathbf{16}_2$, and shaft 17 cooperate in a similar manner as insert station S1, gripper arm $\mathbf{16}_1$, and shaft 17 and serve to withdraw one insert from the stack of inserts at station S2 and drop that insert onto raceway 18. More particularly, insert stack station S2 holds a stack of inserts $I_2$ in a manner whereby the bottommost insert is separable from the rest of the stack. Gripper arm $\mathbf{16}_2$, which is also connected to oscillating shaft 17, rotates toward the bottommost insert; grabs that insert; rotates away from the stack; and, then releases the insert. This insert falls onto insert raceway 18 which already contains an insert $I_1$. Pusher pins P of raceway 18 advance this pile to the next insert station. Thus, during another machine cycle, insert station S2, gripper arm $\mathbf{16}_2$, shaft 17, and raceway 18 cooperate to add an insert $I_2$ to insert $I_1$ and convey the pile to station S3.

Insert station S3, gripper arm $\mathbf{16}_3$, and shaft 17 cooperate in a similar manner as insert stations S1 and S2, gripper arms $\mathbf{16}_1$ and $\mathbf{16}_2$, and shaft 17 and serve to withdraw one insert from the stack of inserts at station S3 and drop that insert onto raceway 18. Insert stack station S3 separates the bottommost insert from the rest of a stack of inserts I3. Gripper arm $\mathbf{16}_3$ rotates toward the bottommost insert; grabs that insert; rotates away from the stack; and, releases the insert onto inserts $I_1$ and $I_2$ on raceway 18. This thereby completes the pile of inserts. Raceway 18 then conveys the completed pile to inserting station IS. Thus, during a third machine cycle, insert station S3, gripper arms $\mathbf{16}_3$, shaft 17, and raceway 18 cooperate to add an insert $I_3$ to a pile of inserts and convey the pile to inserting station IS.

In view of the foregoing, it will be seen that insert stack stations S1, S2, and S3, respective gripper arms $16_1$, $16_2$, and $16_3$, and insert raceway 18 cooperate to collect a pile of inserts and convey that pile to inserting station IS in three machine cycles.

As mentioned above, insertion machine 10 conveys an open envelope to inserting station IS. To this end there are provided an envelope stack station ES; an envelope flap opening station EO; a flap hold down bar 19; and, an envelope raceway 21. Envelope stack station, ES holds a stack of envelopes; separates the bottommost envelope from the rest of the stack; and, feeds the envelope to a clamp C in envelope raceway 21. Envelope raceway 21 includes clamp C which is mounted on a chain (not shown) which is periodically driven by machine 10. The chain is driven once during a portion of each machine cycle and moves the envelope to an envelope flap opening station EO. At station EO, a sucker cup (not shown) rotates toward the closed flap of an envelope, applies a vacuum to the flap and rotates away from the envelope in order to open the flap of the envelope. The raceway 21 then moves the envelope to the inserting station IS while the flap of the envelope is held down by bar 19.

When an envelope and a pile of inserts are at inserting station IS, insertion machine 10 inserts the pile of inserts into the opened envelope. To this end, there are provided in machine 10, a pusher arm PA, and a vacuum bar VB. The vacuum bar VB lifts up the back (top) side of the envelope and shaft 17 rotates and thereby moves pusher arm PA toward the opened envelope. As a result, the pile of inserts will be pushed into the envelope. Thus, pusher arm PA and vacuum bar VB cooperate to insert a pile of inserts into an opened envelope at inserting station IS.

Although FIG. 1 shows an insertion machine with three insert stack stations S1, S2, and S3, it should be understood that the number of insert stack stations is not critical to the present invention and that in other embodiments fewer or more such insert stations are employed along a suitable raceway.

During the operation of machine 10 it is highly desirable to provide an indication when one of the gripper arms grips too few or too many inserts. Insertion machine 10 includes an improved double/miss detector which is relatively easy to calibrate and adjust and which is described in the incorporated U.S. patent application Ser. No. 648,391, filed Sept. 7, 1984 by Vandersyde et al.

In addition, it should be appreciated that it is desirable to provide a reliable gripper arm. Insertion machine 10 includes a reliable gripper arm which will now be described.

GRIPPER ARM MECHANICAL STRUCTURE

Figure 1A:
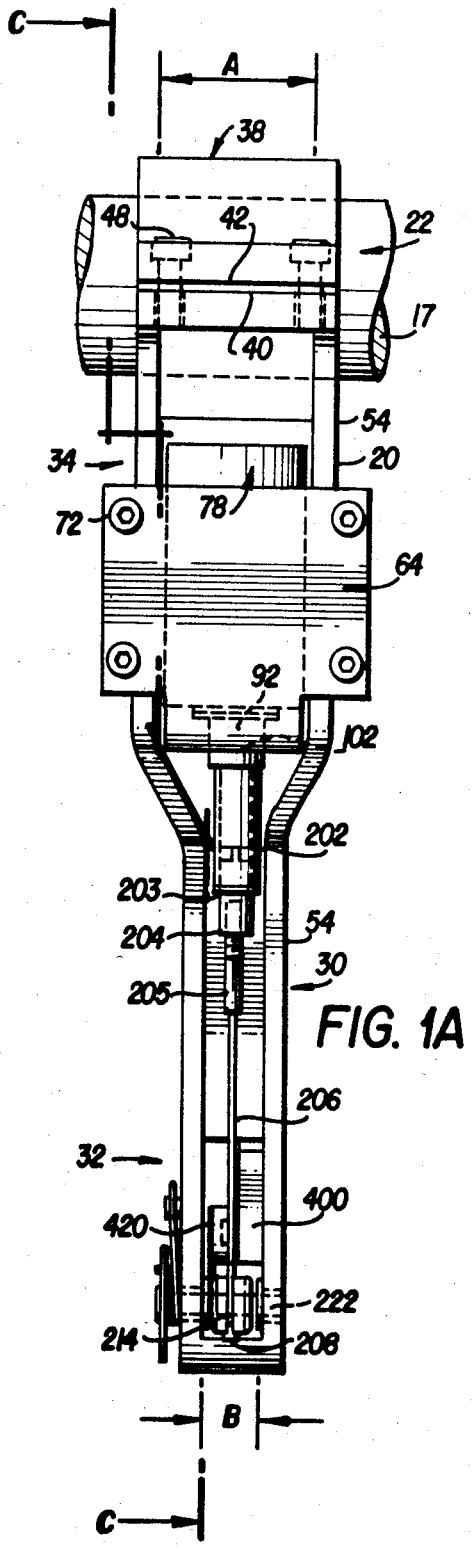
FIG. 1A is a rear view of a gripper arm according to an embodiment of the invention.
Figure 1B:
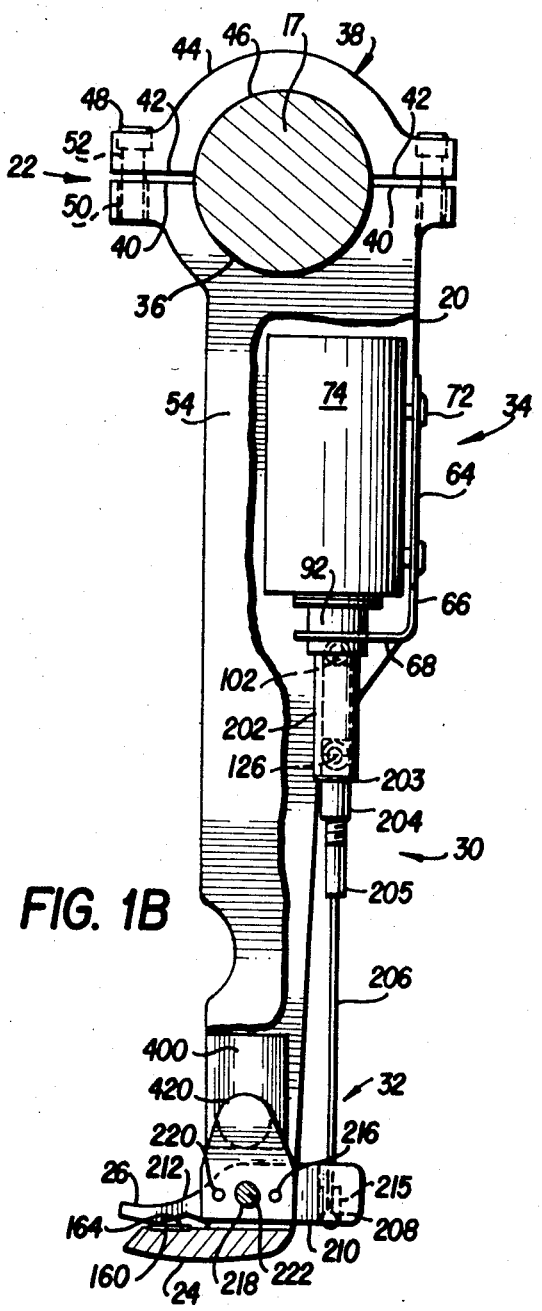
FIG. 1B is a side view taken along the line "C" of the gripper arm of FIG. 1A.
Figure 2:
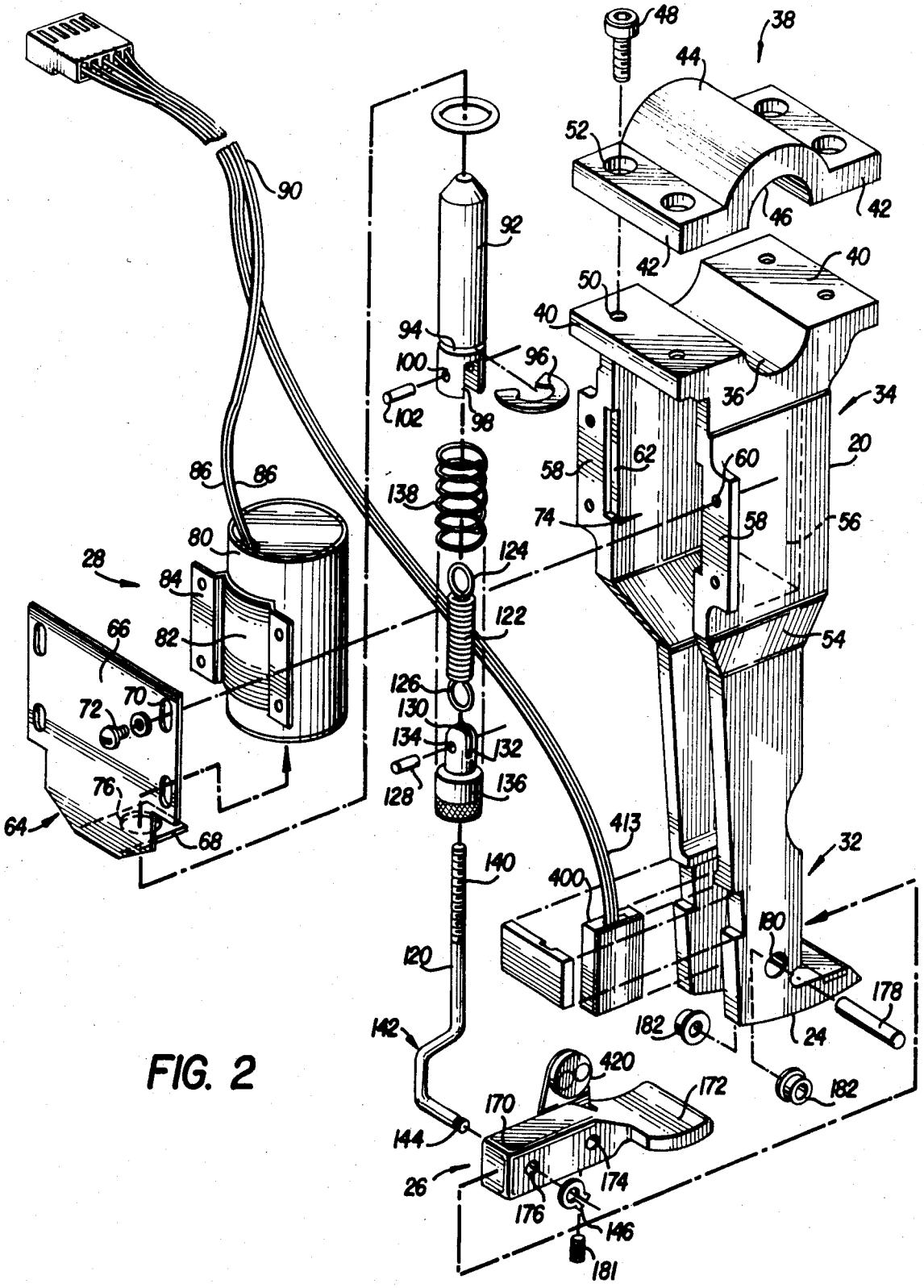
FIG. 2 is an exploded view of the gripper arm of another embodiment of the invention.
Figure 3:
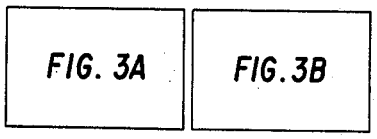
FIG. 3 is a diagram showing the relationship of FIGS. 3A and 3B.
Figure 4:
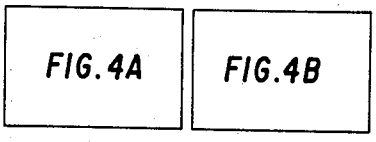
FIG. 4 is a diagram showing the relationship of FIGS. 4A and 4B.
Figure 6:
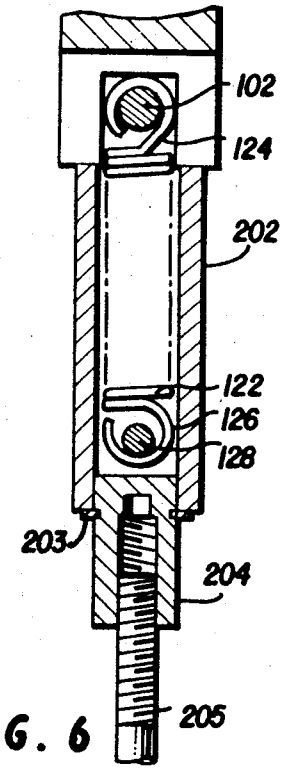
FIG. 6 is a detailed view of a portion of the gripper arm of FIG. 1A.

Each gripper arm 16 according to an embodiment of the invention includes a housing 20; securing means 22 for securing the gripper arm to oscillating drive means such as shaft 17; a first article-contacting or jaw member 24; a second article-contacting or jaw member 26; jaw actuation means, such as solenoid actuation means 28; and, linkage means 30. FIGS. 1A and 1B (as well as FIGS. 6, 7A, and 7B) show a gripper arm according to one embodiment of the invention while FIG. 2 shows a gripper arm of a second embodiment which is generally similar to the embodiment of FIG. 1 but which includes different structure for its linkage means. Structural elements common to the embodiments of FIGS. 1A and 1B and FIG. 2 are assigned the same reference numerals for description purposes hereinafter.

Gripper arm housing 20 has a distal end 32 and a proximal end 34. The means 22 for securing the gripper arm to the oscillating drive shaft 17 includes (1) a semicylindrical recess 36 at the top of the proximal end 34 of the gripper arm housing 20, and (2) a clamp member 38. The recess surface 36 is contiguous with flanges 40 on either side of the recess 36. The flanges are generally parallel to the major cylindrical axis of the recess 36. The clamp member 38 mates with the proximal end 34 of the housing 20. The clamp 38 is formed with comparable flanges 42 which mate with the flanges 40 of housing 20. The clamp 38 has a cylindrical sector portion 44 which forms a semicylindrical recess 46. Each of the flanges 40 and 42 have two threaded apertures therein appropriately aligned to receive threaded fasteners 48. In this respect, flanges 40 have apertures 50 and flanges 42 have apertures 52. The fasteners 48 secure clamp 38 to the proximal end 34 of the housing 20 so that the gripper arm is clamped onto the oscillating drive shaft 17. Each threaded fastener 48 extends through the aligned apertures 50,52 and the housing flanges 40 and the clamp flanges 42, respectively.

The gripper arm housing 20 comprises opposing side panels 54 which extend the height of the gripper arm. The two side panels 54 define a space therebetween. At the proximal end 34 of the gripper arm housing 20 the side panels 54 are parallel and separated by a distance A as shown in FIG. 1A. At the mid-section of the gripper arm housing the side panels 54 begin to converge to one another but separate before doing so and continue in parallel manner to the distal end 34 of the housing 20. At the distal end of the housing the side panels 54 are spaced apart at a distance B which is less than distance A as shown in FIG. 1A.

In the region where the side panels 54 are separated by the distance A, a front panel 56 is integral with the side panels 54. In this region where the side panels 54 are separated by the distance A, each side panel 54 has at its back a perpendicularly extending flange 58. Each flange 58 has two threaded apertures 60 therethrough, as well as a vertically extending channel 62 at the intersection of the plane which includes the interior surface of the housing-side panel 54 and the plane which includes the flange 58.

The gripper arm housing 20 also includes a backplate 64 which has a back member 66 and a base member 68 perpendicular thereto. The back member 66 has four apertures 70. Two of the apertures 70 are on each side of the back member 66, each aperture 70 being aligned with apertures 60 on the side panel flanges 58 when the back member is assembled to housing 20. Threaded fasteners 72 extend through the apertures 70 of backplate 64 and through the aperture 60 of the side panel flanges 58 to secure the backplate 64 to the gripper arm housing 20. The base member 68 of the backplate 64 is adapted for placement between the side panels 54 in an area where the side panels begin to converge.

As described above, the side panels 54, front plate 56, back member surface 56, and backplate base member 58 generally define a hollow volume 74. Volume 74 is not totally confined, however, inasmuch as the base member 68 of the backplate 64 has an aperture 76 therein and the height of the back member 66 of backplate 64 is such as to leave an essentially rectangular gap 78 above the backplate 64.

Volume 54 houses the jaw actuating means which, in the illustrated embodiment, is solenoid means 28. The solenoid means 28 has an essentially cylindrical casing 80. Solenoid casing 80 has a mounting plate 82 secured thereto. In the embodiment shown, the mounting plate 82 has protrusions 84 thereon adapted to fit into the channel 62 of the side panel flanges 58. As shown in FIG. 2, electrical leads 86 extend from the interior of the solenoid casing 80 and are included in a ribbon-type cable 90. Although not shown as such in FIG. 1A, it should be understood that the ribbon cable 90 extends from the volume 74 out through the rectangular gap 78 on the back of the gripper arm and is connected to appropriate circuitry including the type of circuit shown in FIGS. 3A and 3B. The circuitry to which the ribbon cable 90 is connected resides on a circuit board or the like situated elsewhere on the particular machine in conjunction with which the gripper arm of the invention operates.

The solenoid means 28 also comprises a plunger means 92. Near its base plunger means 92 has an annular groove about which C-clamp retainer 96 fits. The lower end of the plunger 92 has a slot 98 therein through the diameter of the plunger 92. The plunger 92 also has an aperture 100 extending therethrough along a diameter of the plunger 92 which is transverse to the slot 98. The plunger aperture 100 is adapted to receive a rollpin 102.

Turning now to the embodiment of FIG. 2, the linkage means 30' comprises a biasing means and a connecting rod 120. The biasing means includes a cylindrically coiled inner spring or extension spring 122 having coils formed generally in planes perpendicular to the major axis of the cylinder. The inner spring 122 has first and second ends formed in ring-like fashion, the end rings being formed in planes in which the axis of the cylinder lies (that is, the planes of the end rings are generally perpendicular to the planes of the coils included in inner spring 122). Ring 124 at the upper end of the inner spring 122 is adapted to receive pin 102 therethrough when the ring 124 is inserted into the slot 98 of the plunger 92. Ring 126 at the lower end of the inner spring 122 is adapted to receive a pin 128. Lower ring 126 receives pin 128 when the lower ring 126 is inserted into a transverse slot 130 formed in a first end of end cap 132. End cap 132 has an aperture 134 through the diameter thereof which intersects the slot 130 in perpendicular fashion in a manner similar to the slot 98 in apertures 100 of the plunger 92.

End cap 132 has an annular shoulder 136 near its midsection so that an outer spring 138 can be confined between the shoulder 136 and the base member 68 of the backplate 64. Thus, the outer spring 138 is of greater diameter than the inner spring 122 fits in concentric fashion over the inner spring 122. The outer spring 138, according to one mode of the invention, preloads the inner expansion spring 122 by stretching spring 122 a desired distance so that spring 122 causes jaw 26 to exert a force of a desired magnitude on inserts engaged between jaws 24 and 26.

As further seen in FIG. 2, the lower end of the end cap 132 receives a threaded top 140 of the connecting rod 120. The connecting rod 120 extends between planes in which the side panels 54 are included downwardly toward the distal end 32 of the housing 20. The rod crooks outwardly to the side at point 142 as it extends downwardly, and then bends inwardly to have a portion 144 in horizontal orientation at the lowest extent of its travel. The lower end 144 of the rod is adapted to receive a lock member, such as C-clamp retainer 146.

The distal end 32 of the gripper arm housing 30 has, in the FIG. 2 embodiment shown, a first jaw member 24 which is formed integral with the housing 20 as a lower jaw member. A rectangular recess 160 is formed in a surface of the jaw 24 which is oriented to contact an article to be engaged by the gripper arm. The recess 160 is adapted to receive a piece of high coefficient of friction material, such as a piece of urethane 162.

The second jaw member 26 as shown in FIG. 2 comprises a block 170 insertable in a space defined by the separated lower ends of the side panels 54. The block 170 has a protruding curved member 172 extending therefrom, the underneath surface of which contacts articles to be engaged by the gripper arm. Block 170 also has two apertures 174 and 176 extending therethrough. The aperture 174 is adapted to receive a pivot pin 178 so that the second jaw member 26 can pivot about the pin 178. The second aperture 176 is adapted to receive the horizontally extending lower end portion 144 of the connecting rod 122.

The pivot pin 178 is received not only through aperture 174 in the jaw member 26, but also through aligned apertures 180 in the distal end of the side panels 54. Thus, when the second jaw member 26 is inserted in the space between the side panels 54 near the distal end 32 of the gripper arm housing 20, the apertures 174 and 180 are aligned so that the pivot pin 178 can freely fit therethrough. The pivot pin 178 is retained in position by a set screw 181 so that the pivot pin 178 rotates in bearing-like end caps 182.

The embodiment of FIGS. 1A and 1B differs slightly from the embodiment of FIG. 2, in the configuration of the particular linkage means utilized. While the embodiment of FIGS. 1A and 1B, like that of FIG. 2, has an inner spring 122, the inner spring 122 of the embodiment of FIGS. 1A and 1B is positioned in a cylindrical spacer or housing 202. As in the FIG. 2 embodiment, the upper ring 124 of the inner spring 122 is secured by plunger pin 102 to the solenoid plunger 92. The top of the cylindrical housing 202 abuts the lower end of the plunger 92.

The lower end of cylindrical housing 202 abuts a retaining ring 203. The retaining ring 203 is carried in an annular recess on a clevis-type end cap 204. The pin 128 extends radially through the end cap 204 in a manner understood from the description of the end cap 132 of FIG. 2. End cap 204 axially receives a pin 205 which has an upper exterior portion thereof threaded for engagement in an axial aperture of end cap 204. An upper end of a cable 206 is connected to the lower end of pin 205. Cable 206 extends from the pin 205 to the distal end 32 of the gripper jaw. At its lower end the cable 206 has a ball 208 fixedly attached thereto.

Located in the cylindrical housing 202 in the manner described above, the inner spring 122 of FIGS. 1A and 1B is held so that it is generally extended about 0.25 inches beyond its length at rest. The spring 122 is thus preloaded to have a desired spring force.

For the embodiment of FIGS. 1A and 1B, the upper jaw member 26 comprises a block member 210 and a curved protrusion 212. The underside of the protrusion is used to contact articles engaged by the gripper arm. The block member 210 has a narrow slit 214 at the back thereof through which the lower portion of cable 206 extends. At the base of the slit 214 is an essentially square chamber 215. Chamber 215 houses ball 208. When cable 206 is pulled upwardly, the ball 208 thereon, having a greater diameter than the width of the slit 214, bears against the top interior surface of the chamber 215, causing the upper jaw member 26 to pivot so that the upper jaw member 26 approaches the lower jaw member 24 so that the jaw essentially closes.

The block member 210 of second jaw 26 also has three apertures 216, 218, and 220 extending therethrough. The central aperture (aperture 218) accommodates a pivot pin 222 about which the jaw member 26 pivots.

Figure 7B:
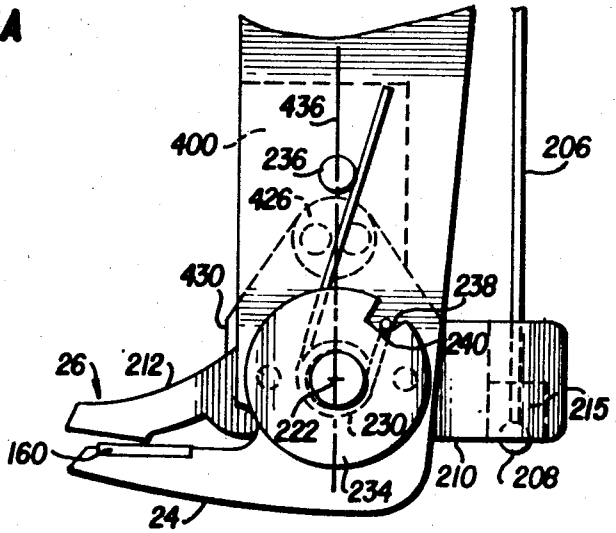
FIG. 7B is a detailed view of a portion of the gripper arm of FIG. 7A cut along the line "D"

The embodiment of FIGS. 1A and 1B further comprises means for biasing the jaw members in an open position. The biasing means includes torsion spring 230 (seen in FIGS. 7A and 7B). An intermediate portion of the torsion spring 230 has a helical shape which is concentric with and fits over an exposed end of pivot pin 222, the end of pin 222 protruding beyond a side panel (the left side panel as seen in FIG. 7B) of the gripper arm. At its exposed, protruding end the pivot pin 222 has a head 232 formed thereon. A disc 234 is secured on the pivot pin 222 just inside its head 232. The helical portion of the torsion spring extends between the disc 234 and the left side panel of the gripper arm. At one of its ends the torsion spring 230 departs from its helical configuration and assumes a linear shape as it extends upwardly to a retaining pin 236 against a side of which it bears (see FIG. 7B). At its other end the torsion spring 230 extends through a square notch 238 formed on the circumference of the disc 234. The portion of the torsion spring 230 that extends through the disc 234 bears against a corner 240 of the notch 238. Spring 230 bears against corner 240 to exert a biasing force on the disc 234 and the pivot pin 222 whereby the upper jaw member 26 is normally held open in the absence of application of tension to the cable 206. When cable 206 and ball 208 thereon are urged upwardly, however, ball 208 bears against the upper interior surface of the chamber 215 and exerts a force on block 210 which overcomes the biasing force of the torsion spring 230 so that block 210 pivots about pin 222, thus causing jaw 26 to close.

Figure 7A:
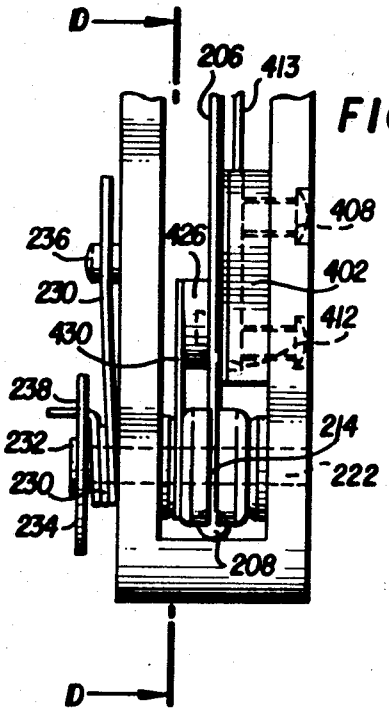
FIG. 7A is a detailed rear view of a portion of the gripper arm of FIG. 1A.

Reference numerals on the order of 400 seen in FIGS. 7A and 7B concern mistake detection apparatus. The details of such mistake detection apparatus in conjunction with which the gripper arm of the present invention operate are understood from the incorporated U.S. patent application Ser. No. 648,391, filed on Sept. 7, 1984 by Vandersyde et al.

GRIPPER ARM ACTUATION CONTROL MEANS STRUCTURE

Figure 8:
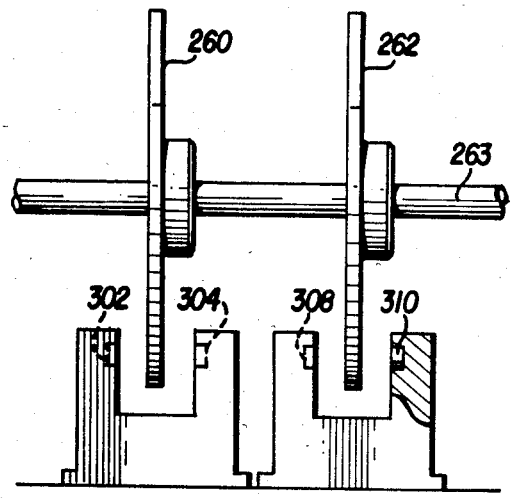
FIG. 8 is a side sectional view showing first sensor means and second sensor means mounted in relationship to main drive shaft means; and, FIG. 9 is an end view of an actuator timing disc included in a second sensor means.
Figure 9:
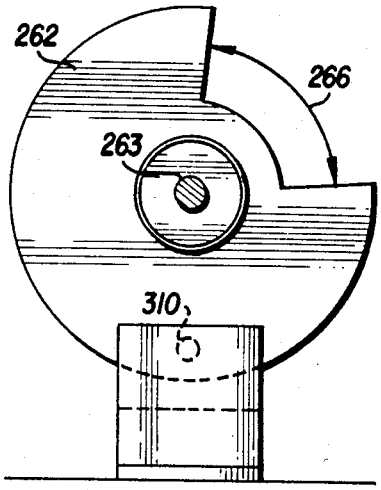
Figure 3A:
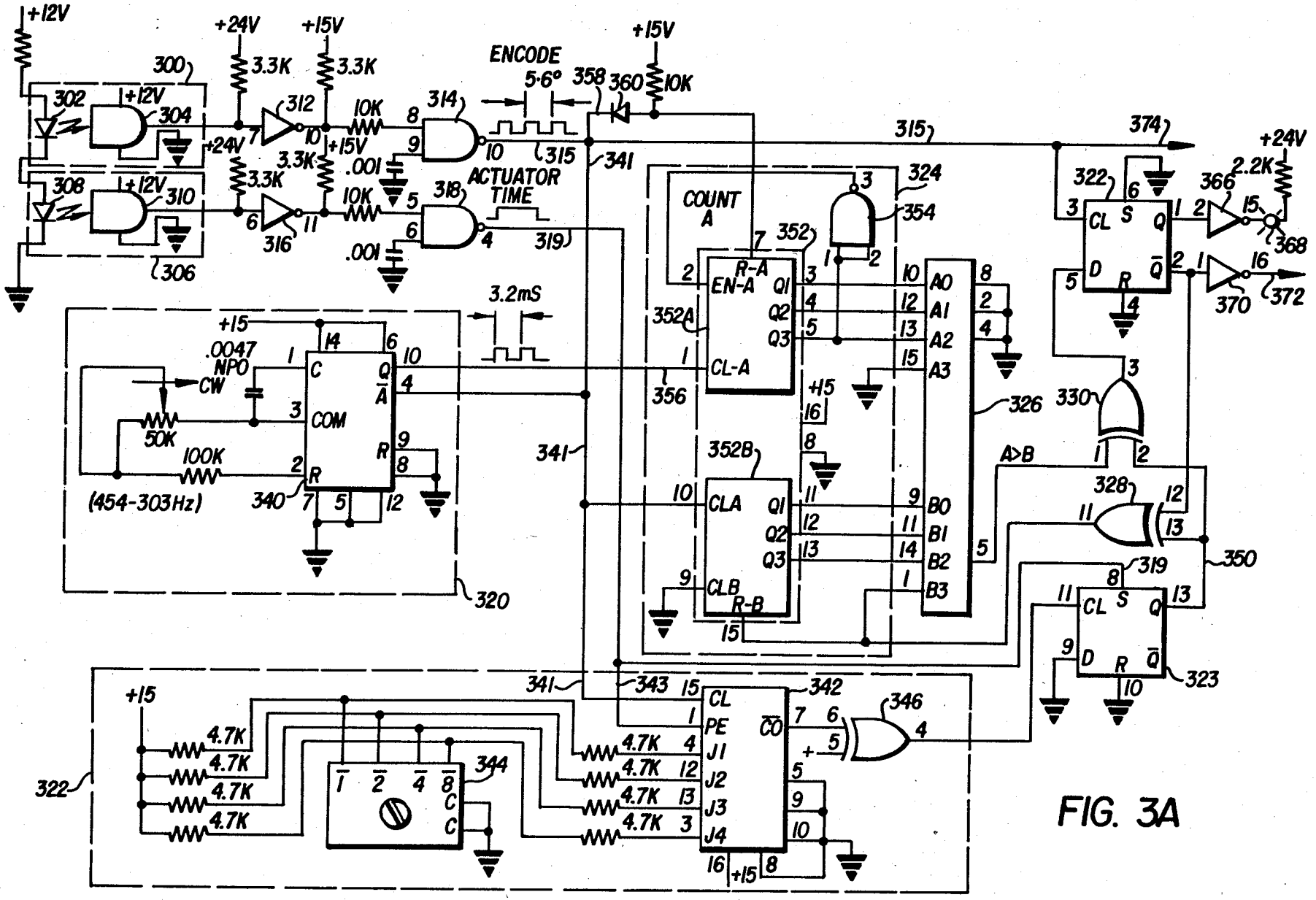
FIG. 3A and FIG. 3B are schematic diagrams depicting electrical circuitry included in actuator control means according to an embodiment of the invention.
Figure 3B:
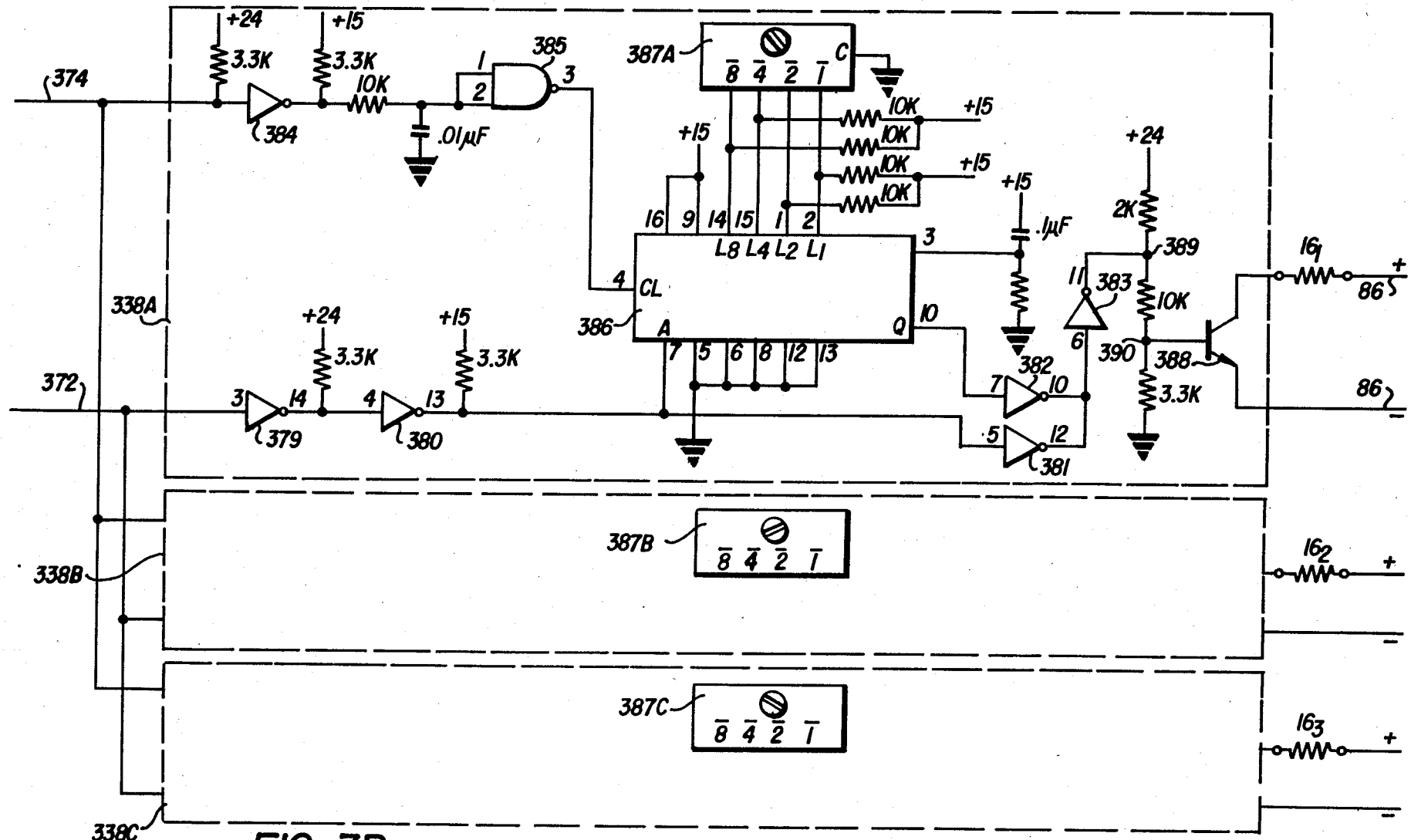

FIGS. 3A and 3B show the circuitry of control means for actuating a plurality of gripper jaws according to an embodiment of the invention. As shown in FIGS. 8 and 9, an encoder disc 260 and an actuator timing disc 262 are mounted to rotate on a main drive shaft 263 of a machine, such as an insertion machine, in connection with which the gripper arm 16 of the invention operates. The main drive shaft rotates once per machine cycle and has various timing and drive means rigidly coupled thereto for power transmission, such as the aforementioned oscillating drive means 17, for example. The encoder disc 260 is a 64-tooth disc. The actuator timing disc 262 has its circumference configured to allow the passage of light (in a direction perpendicular to the plane of the disc) about a disc central angle 266 corresponding to portions of a machine cycle during which the actuation means of the gripper arm is to be actuated so that the second jaw is either in contacting relation with the first jaw or has an article gripped between the first jaw and the second jaw.

FIG. 3A shows an encoder disc sensor 300 including the above-mentioned encoder disc 260 positioned to cause passage of light from an LED 302 to be periodically incident on circumferential teeth of the encoder disc. If the light from LED 302 impinges on a tooth of the disc, then the light is not transmitted to receiver 304. If a circumferential space between the teeth on the encoder disc is aligned with a beam of light from LED 302, then the receiver 304 detects the light. An actuator timing disc sensor 306 also includes the above-mentioned actuator timing disc 262 with an LED 308 and a photoreceiver 310 similarly arranged about the actuator timing disc.

The opto-interrupt receiver 304 is connected to an inverting driver 312. The output terminal of driver 312 is connected through a 10K resistor to the two tied-together input terminals of an encoder NAND gate 314. The output terminal of encoder NAND 314 is connected to line 315. Likewise, the opto-interrupt receiver 310 is connected to the input terminal of an inverting driver 316. The output terminal of the inverting driver 316 is similarly connected through a 10K resistor to the two tied-together input terminals of an actuator timing NAND gate 318. The output terminal of actuator timing NAND 318 is connected to line 319.

The means for controlling the actuation of a plurality of gripper jaws as shown in FIGS. 3A and 3B further includes oscillator or clock means (shown framed by the broken line 320); master presettable release delay means (shown framed by the broken line 322); multivibrator means such as "D"-type flip-flop 323; counter means (shown framed by the broken line 324); count comparison means (such as the 4-bit magnitude comparator 326); EOR gates 328 and 330; multivibrator means such as "D"-type flip-flop 332; an encoder pulse bus 334; an actuator timing bus 336; and, a plurality of station presettable release delay means (such as the three such delay means respectively framed by the broken lines 338A, 338B, and 338C). In this respect, the station presettable release delay means 338A is associated with the first insert station S1; the release delay means 338B is associated with the second insert station S2; and, the release delay means 338C is associated with the third insert station S3. Except for the fact that the delay means 338B and 338C electrically connect to their corresponding solenoid actuators and gripper arms $16_2$ and $16_3$, respectively, the circuit details of delay means 338B and 338C are similar to the structure disclosed for station presettable release delay means 338A and therefore are not fully shown.

The clock means 320 comprises a gatable oscillator multivibrator 340 which has pins 5, 7, 12, 8, and 9 grounded and pins 4 and 16 connected to +15 volts. Pins 1 and 3 of the multivibrator 340 are connected together through a 0.0047 farad capacitor while pins 3 and 2 are connected through the series combination of a 100K resistor and a 50K trimpot. In the configuration shown, the multivibrator 340 is adapted to produce pulses at its Q output terminal (pin 10) having a period of 3.2 milliseconds when a false signal is applied on lines 315 and 341 to pin 4 (the $\overline{A}$ input).

The master presettable release delay means comprises a presettable down counter 342; a master presettable release delay thumbwheel switch 344; and, an EOR gate 346. The down counter 342 is of the type wherein the presence of a true signal (on lines 319 and 343) at the preset enable terminal (pin 1) allows the counter to store therein the binary value seen at the preset data input terminals (pins 4, 12, 13, and 3). These preset data input pins are each connected through a 4.7K resistor to the output terminals of the master delay thumbwheel switch 344. Thumbwheel switch 344 has a dial thereon which, when positioned in the $\overline{1}$ position causes a binary 1 to be stored in presettable counter 342; when positioned in the $\overline{2}$ position causes a binary 2 to be stored in the counter 342; and so forth for the $\overline{4}$ and $\overline{8}$ positions. The clock input pin (pin 15) of the down counter 342 is connected by lines 315 and 341 to the output terminal of the encoder NAND 314. Pins 5, 9, 10, and 8 of counter 342 are grounded; pin 16 is connected to +15 volts. The carryout pin ($\overline{CO}$) of down counter 342 is adapted to produce a false signal when it is counted down from its preset value to zero.

The EOR 346 has its first input terminal connected to the $\overline{CO}$ terminal of down counter 342 and its other input terminal connected to a true level voltage. The output terminal of the EOR 346 is connected to the clock input terminal (pin 11) of the flip-flop 323.

The set terminal of flip-flop 323 is connected by line 319 to the output terminal of the actuator timing NAND 318. The D (data) and R (reset) pins of the flip-flop 323 are grounded. The Q output pin of the flip-flop 323 is connected by a line 350 to input terminals of the EOR gates 328 and 330.

The counter means 324 includes a dual synchronous decade counter shown framed by the broken line 352 and a NAND gate 354. Counter 352 includes two counters—Counter A (also known as counter 352A) and Counter B (also known as counter 352B).

The clock input pin (pin 1) of counter 352A is connected by line 356 to the Q output terminal of the multivibrator 340 whereby counter 352A receives clock pulses when the signals on lines 315 and 341 are false (i.e. the encoder pulses are false). Output pins Q1, Q2, and Q3 of counter 352A are connected to input pins $A_0$, $A_1$, and $A_2$ included in a first input bank of the comparator 326. Output pin $Q_3$ is also connected to the two input terminals of NAND gate 354. The output terminal of NAND 354 is connected to the clock enable pin (pin 2) of counter 352A. The reset terminal of counter 352A is connected through line 358 (having diode 360, thereon) and line 315 to the output terminal of the encoder NAND 314 whereby counter 352A is reset upon the reception of leading edges of each encoder pulse.

The clock enable pin (pin 10) of counter 352B is connected through lines 341 and 315 to the output terminal of the encoder NAND 314. The clock input pin (pin 9) of counter 352 is grounded. Output pins $Q_1$, $Q_2$, and $Q_3$ are connected to corresponding input pins $B_0$, $B_1$, and $B_2$ in a second bank of the comparator 326. The reset pin (pin 15) of counter 352B (as well as the input pin $B_3$ of comparator 326) is connected by line 362 to the output terminal of the EOR 328.

Output pin 5 of the comparator 326 is connected by line 364 to an input terminal (pin 1) of the EOR 330. In being connected to pin 5, line 364 carries a true signal only when the binary value presented at the first or "A" input bank of comparator 326 is greater than the binary value presented at the second or "B" input bank. Input pin 2 of the EOR 330 is connected by line 350 to the Q output pin of the flip-flop 323.

The "D" terminal (pin 5) of the flip-flop 332 is connected to the output terminal of the EOR 330. The clock input terminal (pin 3) of flip-flop 332 is connected by the line 315 to the output terminal of the encoding NAND 314. The Q output terminal (pin 1) of flip-flop 332 is connected through an inverting driver 366 to an LED 368. The $\overline{Q}$ output pin (pin 2) of the flip-flop 332 is connected both to an input terminal (pin 12) of the EOR 328 and to the input terminal of an inverting driver 370. The output terminal of the inverting driver 370 is in turn connected by line 372 to the actuator timing bus 336. The set and reset terminals of the flip-flop 332 are grounded.

The encoder pulse bus 334 shown in FIG. 3B is connected by line 374 and line 315 to the output terminal of the encoding NAND 314.

The station presettable release delay means 338A shown in FIG. 3B comprises inverting drivers 379, 380, 381, 382, 383, and 384; NAND gate 385; presettable shift register means (such as 64-bit presettable shift register 386); station thumbwheel switch 387; and, an NPN driver transistor 388.

The input terminal of the driver 379 is connected to the actuator timing bus 336. The output terminal of the driver 379 is connected to an input terminal of the driver 380, whose output terminal is connected both to the preset enable pin (the "A" pin or pin 7) of the shift register 386 and to an input terminal of the driver 381. The output terminal of the driver 381 is connected to the input terminal of the driver 383. The output terminal of the driver 383 is connected to a point 389 on a voltage division network. In the voltage division network, a 2K resistor is connected between point 389 and +24 volts; a 10K resistor is connected between point 389 and a point 390; and, a 3.3K resistor is connected between point 390 and ground. Point 390 of the voltage division network is connected to the base of the driver transistor 388. Driver transistor 388 is connected in a circuit by leads 86 to the gripper jaw actuating means such as solenoid 28.

An input terminal of the inverting driver 384 is connected to the encoder pulse bus 334. The output terminal of the driver 384 is connected through a 10K resistor to both input terminals of the NAND 385. The NAND 385 has its output terminal connected to the clock input terminal (pin 4) of the shift register 386. The output terminal Q (pin 10) of the shift register 386 is connected to the input terminal of the driver 382. The output terminal of the driver 382 is connected to the input terminal of the driver 383, whose output terminal is connected to the voltage division network in the manner before described.

Station delay thumbwheel switch 387 has four output terminals connected to four corresponding input terminals of the shift register 386. Thumbwheel switch 387 has a dial thereon which, when positioned to point to a $\overline{1}$ position, applies a binary 1 to the input terminals of shift register 386. By moving the indicator dial to the $\overline{2}$ position a binary 2 is applied to the input terminals of the shift register 386, and so forth with respect to the $\overline{4}$ and $\overline{8}$ positions. When a true signal is applied at the preset enable pin (pin 7) of shift register 386 the value applied at the input terminals of shift register 386 as indicated by the dial position on thumbwheel switch 387 determines the length of the shift register 386. When the true signal is removed from the preset enable pin (pin 7) of shift register 386, the shift register 386 is shifted in response to the receipt of clock pulses at pin 4. When the preset data has completely shifted through the shift register 386, the output terminal Q goes from a true value to a false value.

As mentioned before, the structure of the station presettable release delay means 338B and 338C for stations S2 and S3, respectively, are essentially identical to that described with respect to station S1 (i.e. station presettable release delay means 338). However, it should be understood that the thumbwheel 387 for each station is independently set in consideration of the physical characteristics (such as size) of the particular insert material to be engaged at that station and then released by the appropriate gripper arm 16 onto the insert track 18. For example, the thumbwheel switch 387A is set at a position of binary 2; the thumbwheel switch 387B is set at a position corresponding to binary 8; and, the thumbwheel switch 387 for station S3 is set at a position corresponding to a binary 1. In this example, station S2 contains extremely large inserts; station S1 contains fairly large inserts but not as large as those in station S1; and, station S3 contains inserts which are about average size or perhaps just slightly larger than average.

OPERATION

The operation of the actuator control means and associated gripper arm are hereinafter described. The first general phase of operation described hereinafter is the closing of the plurality of gripper jaws to engage inserts between the gripper jaws so as to pull the inserts from its stack at the insert stations. A second general phase of operation described hereinafter is the opening of the plurality of gripper jaws such as takes place when inserts are released for dropping onto the raceway 18.

Figure 4A:
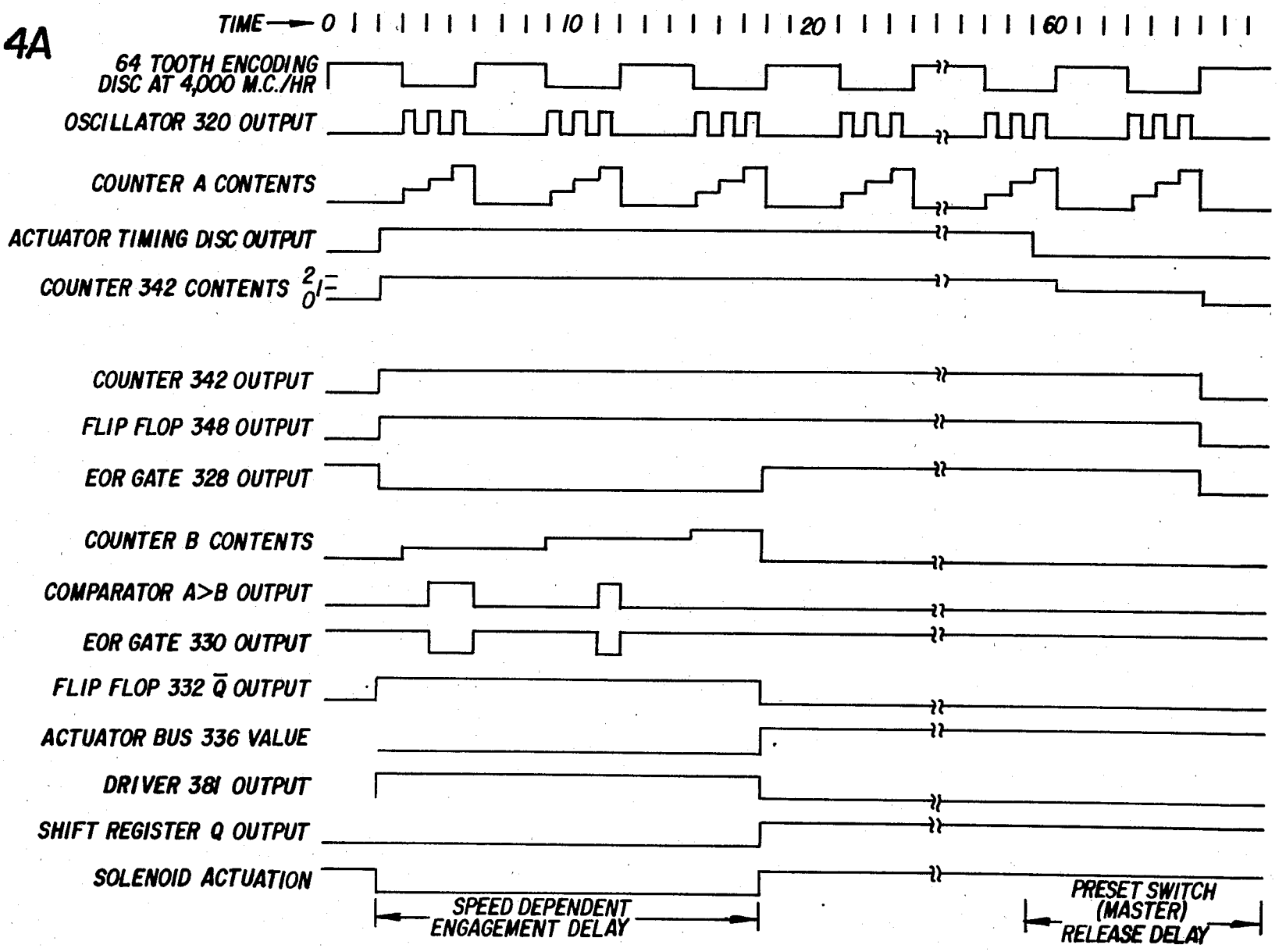
FIGS. 4A and 4B are timing diagrams depicting the electrical states of various electrical components included in the actuation control means of FIGS. 3A and 3B for an insertion machine operating at about 4,000 cycles per hour.
Figure 4B:
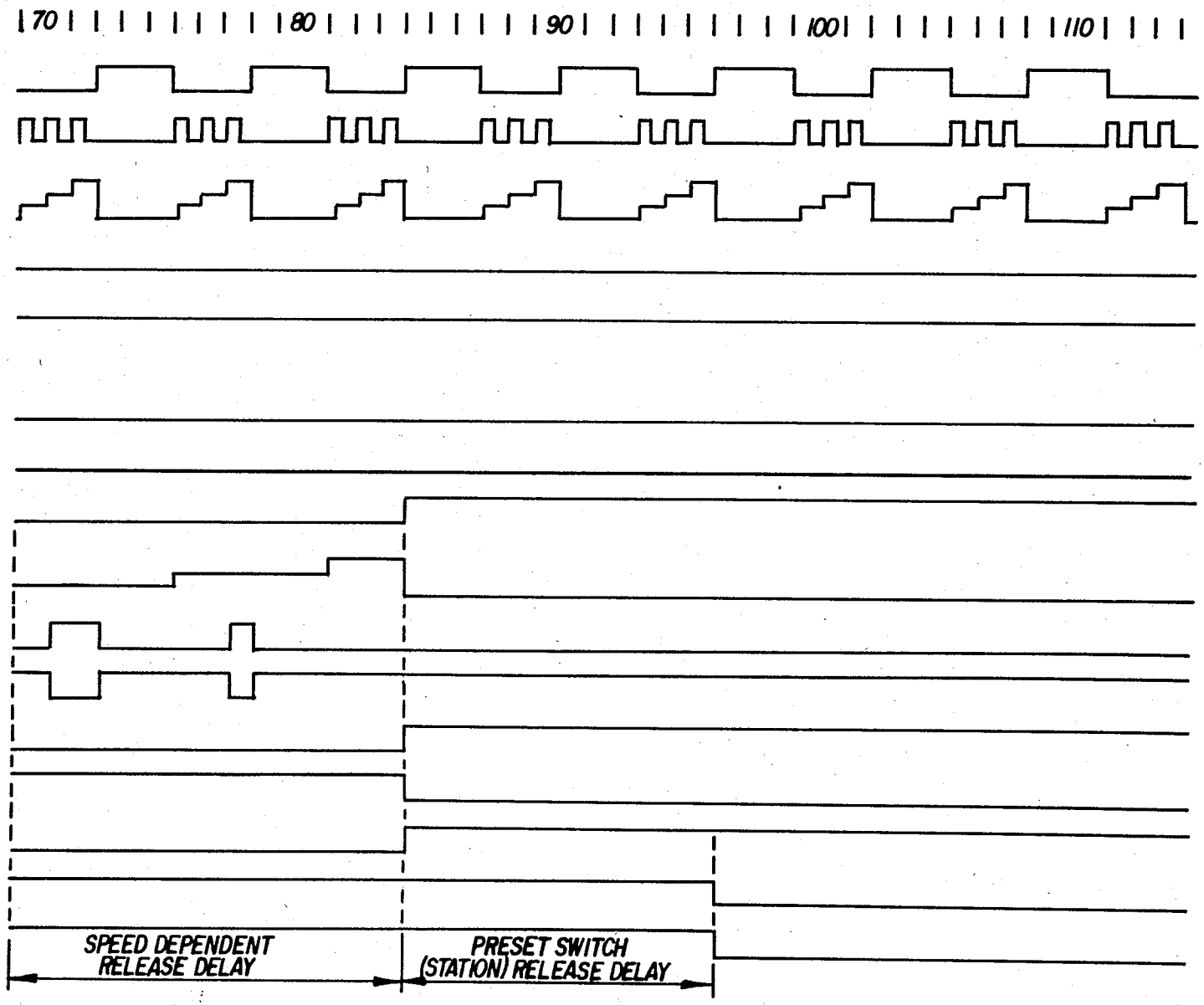

For the most part the ensuing discussion of the operation of the control of the gripper arms assumes that the normal operations of the insertion machine are currently on-going although at a rather slow rate of about 4,000 machine cycles per hour, particularly discussion had with reference to the timing diagrams of FIGS. 4A and 4B. It should be understood that the operation at the selected speed of 4,000 machine cycles per hour is, except for matters of timing, quite similar to that which occurs at a faster speed. In this respect, at an appropriate point in the discussion FIGS. 5A and 5B will be discussed to contrast the timing effects of the slower mode of operation (about 4,000 cycles per hour in FIG. 5A) and a faster mode (about 8,000 machine cycles in FIG. 5B).

The ensuing discussion further assumes that insert station S1 has inserts $I_1$ therein of a rather large size; that insert station S2 has inserts therein of an even larger size; and, that insert station S3 has insert therein which are of about average size. The inserts $I_2$ in insert station S2 are presumed to be so large in fact that the operator has had to move side rail SR1 further away from the row of insert stations, to accommodate the large insert. In view of the presence of such large inserts at station S2 and the required adjustment of side rail SR1, the operator first presets the master delay thumbwheel switch 344 to a greater value to reflect that the rail SR1 has been moved further from the insert stations as shown in FIG. 1A. For our example the thumbwheel switch dial is set to a binary 2 which, as hereinafter seen, means that a release delay in two encoder pulses will occur for each of the insert stations included in the insertion machine. Thus the operator is able to simultaneously institute a uniform release delay for all insert stations to take into consideration the adjusted width of the insert track 18. It will be appreciated that simultaneous adjustment using means 322 provides considerable convenience when adjustments must be made for an insertion machine having a large plurality of stations.

The operator then makes individual adjustments if necessary for each of the insert stations S1, S2, and S3. In this respect, since very large inserts are stored in insert station S2, the operator sets the thumbwheel 387D to its greatest setting ($\overline{8}$) so that the gripper jaw $\mathbf{16}_2$ will have an even further release delay of eight encoder pulses. Since rather large inserts also at station S1 and a further release delay is necessary for properly positioning the inserts on the insert track, the operator sets the dial switch for thumbwheel 387A to the $\overline{2}$ position (meaning that the gripper jaw $\mathbf{16}_1$ is to release its insert after a further delay of two encoder pulses). Since the inserts $I_3$ in insert station S3 are of average size, the operator merely sets the dial of thumbwheel switch 387C to the $\overline{1}$ position for only a one encoder pulse release delay. Thus the operator is able to provide a release delay for each station based on each station's insert size and which is not necessarily uniform from station to station. Moreover, if at any time during operation the positioning of an insert on the insert track 18 seems slightly off, the operator can use the appropriate thumbwheel switch 387 to fine tune the insert placement.

The operation of the timing control means of the embodiment of FIGS. 3A and 3B for an insertion machine having a plurality of insert stations and operating at a rather slow mode of about 4,000 machine cycles per hour is understood with reference to FIGS. 4A and 4B. In this respect, FIGS. 4A and 4B are timing diagrams showing the electrical states of various components included in the circuitry of FIGS. 3A and 3B. In particular, FIGS. 4A and 4B show: (1) a machine operating speed dependent engagement delay component (from time T=2 to T=18); (2) a master preset release delay component occasioned by the setting of thumbwheel switch 344 (from time T=59 to T=69); (3) a machine operating speed dependent release delay component (from time T=69 to T=84); and, (4) a station preset release delay component occasioned by the setting of switch 387 at insert station S1 (from time T=84 to T=96).

During the operation of the insertion machine light from the LED 302 of the opto-interrupter of encoder disc sensor 300 radiates through spaces between the teeth on the encoder disc so as to be incident upon receiver 304, causing the receiver 304 to output a true signal to the inverting driver 312. Inverting driver 312 inverts the true signal to a false signal for application to the encoder NAND 314. A false signal applied to both input terminals of the encoder NAND 314 causes a true signal to be placed on lines 315 and 341.

When the teeth of the encoder disc interrupt the light from between the LED 302 and the receiver 304, a false signal appears at the output of the encoding NAND 314 and hence on lines 315 and 341. Thus, as the encoder disc rotates, a series of pulses is produced. In the series of encoder pulses generated by the 64-tooth disc, the machine main shaft rotates 5.625 degrees of the machine cycle (5.625 DMC) between the leading edges of consecutive true signals. The grafts of encoder pulse trains generated in this manner appear in FIGS. 4A and 4B.

Whenever the encoder pulse signals on lines 315 and 341 are false, the clock 320 is activated to produce clock pulses on line 356 having a period of 3.2 milliseconds. Whenever the encoder pulse goes true, clock 320 ceases its output of clock pulses. As shown in FIGS. 4A and 4B, at a machine operating speed of approximately 4,000 cycles per second the clock 320 produces approximately three clock pulses while the encoder pulses are false. In this respect, the greater the operating speed of the machine the fewer the number of clock pulses occur per encoder pulse.

OPERATION CONTROLLING ENGAGEMENT ACTUATION OF GRIPPER JAWS

When the actuating timing disc 262 is in a position to permit light to pass from LED 308 to receiver 310 actuator timing NAND 318 has a true output which is applied to lines 319 and 343. The particular actuator timing disc discussed with reference to FIG. 4A permits light to pass from LED 308 to photoreceiver 310 during the time T=2 to T=59. It is during this approximate time frame (T=2 to T=59 when light is passing from the LED 308 to the photoreceiver 310) that the insertion machine expects the solenoids 28 associated with the various insert stations to be actuated to an engaged position so that inserts may be engaged therebetween and extracted from the insert stations. However, a delay dependent upon the operating speed of the machine occurs between the time T=2 and the actual engagement actuation of the solenoid 28. In this respect, as hereinafter shown, when the machine is operating at approximately 4,000 machine cycles per hour the speed dependent engagement delay occurs from time T=2 to T=19, a delay of approximately three encoding pulses.

The speed dependent engagement delay occurs while counter 352B counts up a number of encoder pulses equal to the number of clock pulses being clocked into counter 352A during the false portion of each encoder pulse. If the pulse count in the counters 352A and 352B are equal when the leading edge of an encoding pulse is applied to the clock 10 of flip-flop 332, the actuator bus 336 goes true to ultimately actuate each of the solenoids 28 at the insert stations so that inserts are engaged to each of the insert stations.

In the above regard, a true signal on line 319 ultimately removes the true signal that otherwise is present at the reset pin of counter 352B, thereby enabling counter 352B to count up the trailing edges of encoder pulses appearing on line 341. In this respect, the true signal on line 319 sets flip-flop 323 so that a true signal appears at the Q output on line 350. The true signal on line 350 coupled with a true signal from the $\overline{Q}$ output of flip-flop 332 causes the EOR 328 output to go false, thereby removing the reset to counter 352B.

It is noted that the master resettable release delay means 322 has no impact upon engagement actuation. In this respect, while the actuator timing disc permits light to pass to indicate the desired timing of engagement, the true signal on lines 319 and 343 are applied to the preset enable pin of down counter 342. As long as the true signal appears at the preset enable pin of counter 342, counter 342 does not count down but is being preset with the binary value indicated on the master delay thumbwheel switch 344. As long as the down counter 342 is being preset, the carryout terminal of counter 342 is true, causing the output of EOR 346 to go false. With the false output from EOR 346 flip-flop 323 does not clock out pulses.

The trailing edge of the next occurring encoder pulse after the output of actuator timing NAND 318 goes true accomplishes two basic objectives. First, the trailing edge of this next occurring encoder pulse increments counter 352B so that (as shown at time T=4) counter 352B has a "1" value therein. Second, the trailing edge of this next occurring encoding pulse also activates clock 320 so that a series of clock pulses is applied to the clock input pin of counter 352A as long as the signals on lines 315 and 341 are false.

The clock pulses produced by clock 320 are counted by counter 352A. As shown in FIG. 4A, the three clock pulses generated during the time period T=3 to T=6 are counted by counter 352A so that, at the leading edge of the next encoder pulse, counter 352A ultimately contains a "3" value. When counter 352A reached 2, however, the comparator 326 determines that the value in counter 352A exceeded the value in counter 352B and thus applied a high signal on line 364. The true signal on line 364 caused the output of EOR 330 to go false. When clocked in by the leading edge of the encoding pulse occurring at time T=6, the false output signal from EOR 330 failed to change the output of flip-flop 332 so that the state of the actuator bus 336 also remains unchanged (meaning that the solenoids 28 are not yet actuated, i.e. that the gripper jaws are not yet in their engaged position).

At the trailing edge of the next encoder pulse (time T=9) the counter 352B is incremented to contain the value "2". Counter 352A again counts up clock pulses from clock 320. At the time of the leading edge of the next encoding pulse (time T=12) a true signal is occurring on line 364 since comparator 326 determined that the value in counter 352A exceeds the value in counter 352B. The output of EOR 330 is false, meaning that the states of flip-flop 332 and the solenoids remain unchanged.

The trailing edge of the next encoder pulse (at time T=15) causes the counter 352B to be incremented to the value "3". Counter 352A counts up three clock pulses in the manner described before. Thus, at the leading edge of the next encoder pulse (time T=18) the comparator 326 determines that the value in counter 352A does not exceed the value in counter 352B, and accordingly a false signal is appearing on line 364. With the false signal on line 364 and a true signal on line 350, the EOR 330 produces a true output which is clocked into flip-flop 332 by the occurrence of the leading edge of the encoder pulse at time T=18. This clocking in of the true signal from EOR 330 causes output pin $\overline{Q}$ of flip-flop 332 to go false.

A false signal at output pin $\overline{Q}$ of flip-flop 332 basically accomplishes two things. First, it applies a false signal to pin 12 of the EOR 328 which causes the output of EOR 328 to go true. The true output from EOR 328 puts counter 352B in the reset state and makes it further impossible for comparator 326 to find if the contents of counter 352A exceed the value of counter 352B. Secondly, the false signal at output pin $\overline{Q}$ of flip-flop 332 causes (by the action of inverter 370) a true signal to be placed on line 372 and the actuator timing bus 336. As seen hereinafter, the true signal on actuator timing bus 336 results in a substantially undelayed engaging actuation of the jaw members of each of the gripper jaws 16 of the insertion machine.

In the above regard, the station presettable release delay means 338 have no significant delay impact upon engaging actuation of the jaw members. The true signal on actuator timing bus 336 results in a true signal being applied to the preset enable pin (pin 7 of the shift register 386) and to the input terminal of the inverter 381. While the true signal is applied to pin 7 of the shift register 386 the register 386 is preset with the binary value indicated by the dial on its respective thumbwheel switch 387. As long as the register 386 is being preset, the Q output terminal remains true. During this time, however, the output terminal of driver 381 goes false, ultimately causing the driver transistor 388 to conduct. As each of the driver transistors 388 associated with the respective insert stations conducts, the solenoids 28 at the respective insert stations are actuated. The actuation of solenoid 28 creates a force on cable 206 to move cable 206 in an upwards direction, thereby closing a jaw 26 to engage an insert between the jaws 24 and 26. The, amount of force created by the solenoid depends upon such factors as the force curve for the particular solenoid used and its duty cycle. In this regard, the nature of the force curve for the embodiment under discussion is understood with reference to U.S. patent application Ser. No. 648,391 filed on Sept. 7, 1984 by Vandersyde et al. and already incorporated by reference herein.

OPERATION CONTROLLING RELEASING ACTUATION OF GRIPPER JAWS

At time T=59 a pattern on the circumference of the actuator timing disc obstructs the passage of light from the LED 308 to the receiver 310. This obstruction of light basically occurs at points in the machine cycle in which it is desired for the second jaw 26 to open with respect to the jaw 24 as a result of the actuator activation. For reasons such as the operating speed of the machine and the different sizes of the inserts at the insert stations, some delay is required between the point at which the actuator timing disc begins to obstruct light and the actual deactivation of the actuator means so that the gripper jaws 16 release inserts so that the inserts can be deposited on the insert track. As discussed above, the release delay time can have as many as three delay components. The first release delay component is determined by the master presettable release delay means 322 which impacts all insert stations to reflect the position of the side rail SR1 relative to the row of insert stations (i.e. to reflect the width of the insert track). The second release delay component is the machine operating speed dependent release delay which also impacts all insert stations and which basically resembles the speed dependent engagement delay described above. The third release delay component is individually determined for each insert station by that insert station's presettable release delay means 338. Thus, while the master preset release delay component and the speed dependent release delay component are essentially the same for all insert stations, the station preset release delay component varies from station to station. The magnitude of the station preset release delay for each station is dependent upon the value selected on the station's thumbwheel switch 387. In the example under discussion, thumbwheel switch 387A for insert station S1 has been set to $\overline{2}$; thumbwheel switch 387B for the very large inserts at insert station S2 has been set at $\overline{8}$; and, thumbwheel switch 387C for average size inserts at insert station S3 has been set at $\overline{1}$.

When at time T=59 the actuator timing disc begins to preclude the passage of light from LED 308 to photoreceiver 310, the master preset release delay caused by means 322 first occurs, followed by the speed dependent release delay, followed by the station preset release delay. Inasmuch as the binary input values from thumbwheel switch 387 indicates the number of encoder pulses which constitute the station preset release delay, it is understood that the actual release of an insert from gripper jaw $16_1$ of station S1 occurs two encoder pulses after the speed dependent release delay; the release of inserts from gripper jaw $16_2$ of station S2 occurs eight encoder pulses after the speed dependent release delay; and, the release of inserts from the gripper jaw $16_3$ of station S3 occurs one encoder pulse after the speed dependent release delay.

As mentioned above, the first release delay component is the master presettable release delay occasioned by means 322. In this respect, when at time T=59 the actuator disc precludes passage of light from LED 308 to photoreceiver 310, the output of the actuating timing NAND 318 goes false, thereby applying a false signal on line 319 and 343. The false signal on line 319 has no impact on the set terminal of flip-flop 323, and hence no effect on the EOR 350, meaning that a true signal is applied to the reset pin of counter 352B. The true signal at the reset pin of counter 352B precludes counter 352B from counting and hence does not permit the counter means 324 and comparator means 326 to begin implementation of the operating speed dependent release delay component.

The false signal applied to the preset enable pin of the down counter 342 causes the counter 342 to start counting down with the reception of leading edges of encoder pulses at its clock input pin. In the example under discussion with the master delay thumbwheel switch 344 set to a $\overline{2}$ value, the presettable down counter 342 is preset so that its contents is "2". At the leading edge of the next occurring encoder pulse (at time T=60) the counter 342 is decremented from "2" to "1". The leading edge of the very next encoder pulse (time T=66) causes the counter 342 to decrement from "1" to "0".

When the contents of counter 342 reaches "0" the signal at the carryout pin (pin 7) goes false, causing the output of EOR 346 to finally go true. The true going output of EOR 346 enables flip-flop 323 to clock in a false signal which results in a false signal being applied from output pin Q to line 350. It is thus seen that the master preset switch release delay means has provided a release delay component from time T=59 to time T=68 prior to the institution of any other release delay components.

A false signal on line 350 makes possible the generation of the operation speed dependent release delay component. In this respect, the false signal on line 350 causes the output of EOR 328 to go false, thereby removing the reset from counter 352B. Counter 352B can then start counting the trailing edges of encoding pulses, which it does beginning at the time T=68. As described with reference to the speed dependent engagement delay, the trailing edges of the encoding pulses also activates the clock 320 so that counter 352A can count clock pulses on line 356 as long as lines 315 and 341 are false. In similar manner as described with reference to the speed dependent engagement delay, the comparison means 326 puts a true signal on line 364 whenever the contents of counter 352A exceeds the contents of counter 352B. When upon the application of a leading edge of an encoding pulse to the flip-flop 332 it is also determined that the contents of counter 352A does not exceed the contents of counter 352B, the flip-flop 332 fires a low pulse at the $\overline{Q}$ output terminal. As seen in FIG. 4B, this does not occur until three encoder pulses after the counter 352B has started counting. That is, flip-flop 332 switches state at time T=84 to produce a true signal at the $\overline{Q}$ output pin. Thus, the counter means 352 and the comparator 326 working together cause a speed dependent release delay which occurs from time T=69 to time T=84.

The change of state of the flip-flop 332 accomplishes two basic results. First, the true signal at pin $\overline{2}$, coupled with the false signal on line 350, causes the output signal of EOR 328 to go true. The true output of EOR 328 resets counter 352B and precludes the comparator 326 from reaching a determination that the contents of counter 352A is greater than the contents of counter 352B. Second, a change of state of the flip-flop 332 causes the driver 370 to put a false signal on line 372 and the actuating timing bus 336.

The false signal on actuator timing bus 336 eventually activates the actuator means at each of the insert stations, but not before the station presettable release delay means 338 of the respective insert stations has had an opportunity to further delay activation by the preset release delay component indicated on the corresponding station's thumbwheel switch 387. As pointed out before, the delay occasioned by each station presettable release delay means is independently input using the thumbwheel switches 387 for the respective stations. The operation of only one such station presettable release delay means, particularly means 338A for station S1, is described in detail hereinafter, the operation of the remaining delay means 338B and 338C being understood from the discussion of the one station S1.

The false signal on actuator bus 336 results in a false signal being applied both to the preset enable input pin (pin 7) of the presettable shift register 386 and to the input terminal of the inverting driver 381. When pin 7 of the shift register 386 receives a low signal, the register 386, whose length was preset in accordance with the value selected on thumbwheel switch 370A (in our example, a binary 2), begins to shift as leading edges of encoder pulses are received at clock input pin 4. In this respect, the encoder pulses are applied on lines 315, 374, bus 334, and by the driver 384 and the NAND gate 385 to pin 4 of the presettable shift register 386.

With the reception of the leading edge of the next encoder pulse (occurring at time T=90) the shift register makes a first shift. Since the register 386 for means 338A was preset to a length of binary 2, the register 386 still has some value and the Q output pin remains true. At the reception of the leading edge of the next encoding pulse (time T=96), however, the shift register 386 has been completely shifted through its length and the output pin Q accordingly goes false. The false-going output from pin Q of register 386 causes the driver 382 to apply a true signal to driver 383. A false output signal from the inverting driver 383 causes the driver transistor 388 not to conduct, whereby the solenoid 28 associated with gripper arm $\mathbf{16_1}$ for insert station S1 is deactivated. Deactivation of the jaw actuator means that the plunger 92 is free to fall downwardly, as does the linkage 30. Downward action of the lihkage 30 causes the second jaw member 26 to pivot about pivot pin 178 in a direction away from the first jaw member 24.

From the foregoing it is seen that the third release delay component, the station preset release delay component, occurs for station S1 from the time T=84 to the time T=96. The station preset release delay for station S1 is of a duration corresponding to the value selected on terminal switch 387A. For station S1 the station preset release delay component corresponds to two encoder pulses as indicated by the dial setting on thumbwheel switch 387A. Because the dial setting on thumbwheel switch 387B of station S2 is significantly greater ($\overline{8}$), gripper arm $\mathbf{16_2}$ associated with the station S2 releases the much larger insert at station S2 after a significantly longer station preset release delay. Gripper arm $\mathbf{16_3}$ associated with insert station S3, however, releases its average size inserts at an earlier time (T=90) in view of the dial setting at $\overline{1}$ on thumbwheel switch 387C.

Figure 5A:
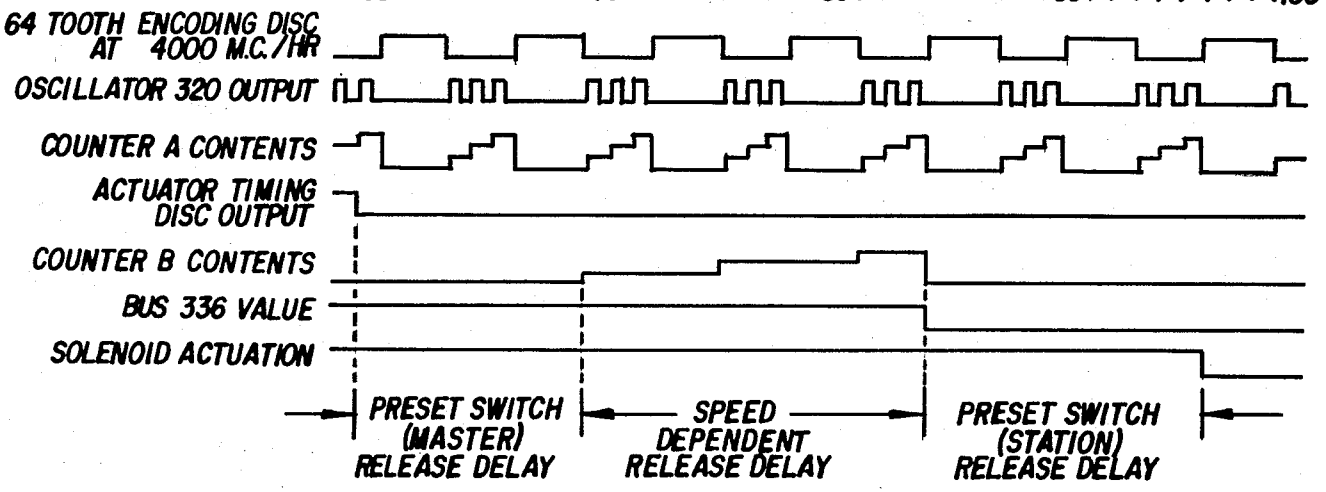
FIGS. 5A and 5B are timing diagrams depicting the electrical states of various electrical components in the actuator control means of FIGS. 3A and 3B for machines operating at about 4,000 cycles per hour and at about 8,000 cycles per hour, respectively.
Figure 5B:
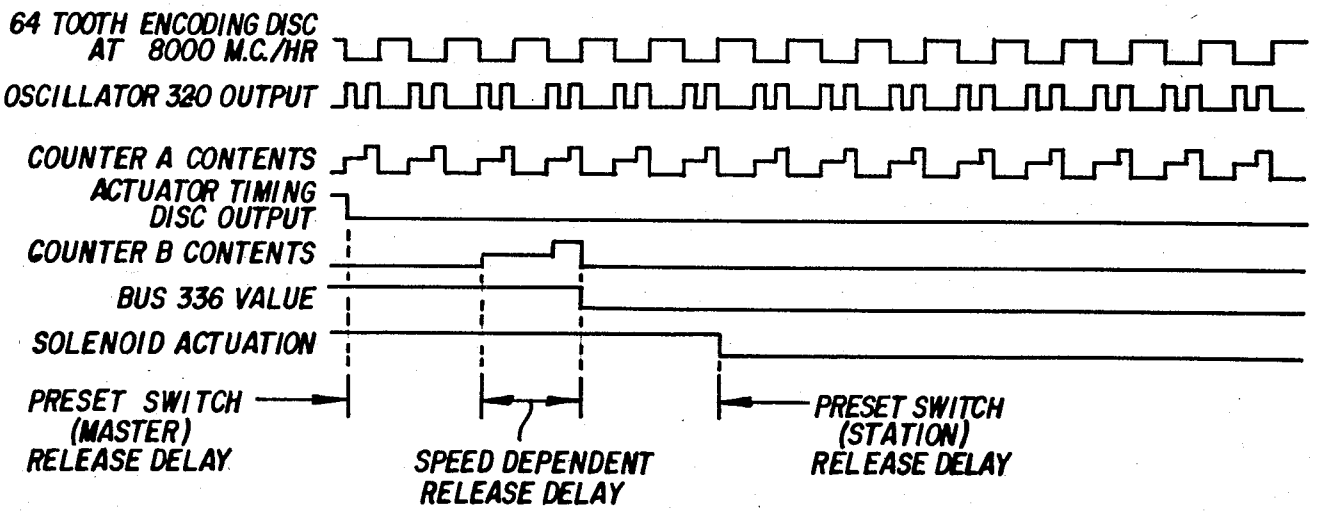

FIG. 5A is a timing diagram showing electrical values for only various ones of the components shown for FIGS. 4A and 4B and for only the time period T=58 through T=100. FIG. 5A shows the release delay time components for an insertion machine operating at the speed of about 4,000 machine cycles per hour, and particularly shows the release delay time components for the gripper jaw $\mathbf{16_1}$ of station S1. FIG. 5B depicts the release delay components for the gripper jaw $\mathbf{16_1}$ of the same machine when it is operating at about 8,000 machine cycles per hour. Master delay thumbwheel switch 344 is set at $\overline{2}$ and the station delay thumbwheel switch 387 is set at $\overline{2}$ in the operating modes of both FIGS. 5A and 5B. Accordingly, it is noted that the master preset release delay component for both the slower and the faster modes are related to the setting of thumbwheel switch 344 (i.e. two encoder pulses), and the station preset release delay component of the both the slower and the faster modes are related to the setting of the station delay thumbwheel switch 387 (i.e. two encoder pulses). The speed dependent release delay component for the two modes differs. In the slower mode of FIG. 5A it is seen that the speed dependent release delay component duration is about three encoding pulses, whereas in the faster mode of FIG. 5B the speed dependent release delay component duration is about two encoding pulses.

EPILOGUE

From the foregoing it is seen that an advantage of the invention is making the time at which the jaw actuator is selectively activated and deactivated dependent upon the speed in conjunction with which the gripper arm operates. Less delay for the deactivation of the actuator is required at higher machine operating speeds than lower machine operating speeds for the gripper arm 16 to carry out operations that result in precise placement of an article engaged and released by a gripper arm. By making the time of the deactivation of the jaw actuator dependent upon the speed of the machine, an operator can set up a machine in a slow jog mode for a gripper arm to deposit an insert at a precise location on transport means such as the insert track with confidence that when the machine is operating at a higher speed essentially the same precise placement of the article will occur.

From the foregoing it is also seen that the present invetion allows an operator to control insert release time in order to provide appropriate release delay time components to compensate for adjustment to insert track width and/or to compensate for insert size. In the foregoing example, for instance, it has been presumed that inserts $I_2$ at station S2 were so large as to necessitate widening insert track 18 by adjustment not only of side rail SR1. In other situations in which side rail SR1 need not be moved to widen the track, the master delay thumbwheel switch 344 can be set to a $\overline{1}$ value so that a minimum preset release delay component occurs. The operator may make appropriate compensation for insert size individually at stations requiring compensation by selecting an appropriate value on the requiring station's thumbwheel switch 387 in order to occasion a station presettable release delay component. At any time including during operation any station's individual station presettable release delay component can be changed to fine tune placement of that station's inserts on the insert track 18.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. An insertion machine comprising:

a plurality of insert stations whereat supplies of insert material are at least temporarily stored;

an insert track which is indexed along said plurality of insert stations for the transport of inserts deposited thereon;

gripper arm means associated with a plurality of insert stations, said gripper arm means each comprising:

a first jaw member;

a second jaw member, said second jaw member being selectively movable with respect to said first jaw member for the engagement of insert material therebetween; and, means for selectively actuating said first and second jaw members to a first position whereby insert material is engageable between said jaws and to a second position whereby insert material is released from between said jaws and deposited on said insert track;

means for controlling said plurality of actuating means whereby the actuation of each of said gripper arms for the release of insert material is delayable, said control means including master presettable delay means whereby for said plurality of gripper arms said delay has a uniform release delay component which is related to a predetermined input value.

2. An insertion machine comprising:

a plurality of insert stations whereat supplies of insert material are at least temporarily stored;

an insert track which is indexed along said plurality of insert stations for the transport of inserts deposited thereon;

gripper arm means associated with a plurality of insert stations, said gripper arm means each comprising:

a first jaw member;

a second jaw member, said second jaw member being selectively movable with respect to said first jaw member for the engagement of insert material therebetween; and, means for selectively actuating said first and second jaw members to a first position whereby insert material is engageable between said jaws and to a second position whereby insert material is released from between said jaws and deposited on said insert track;

means for controlling said plurality of actuating means whereby the actuation of each of said gripper arms for the release of insert material is delayable, said control means including a plurality of station presettable delay means whereby for each of said gripper arms said delay has an independent delay component which is related to a characteristic of insert material at its associated insert station as indicated by a corresponding predetermined input value.

3. A gripper arm in combination with an insertion machine, said gripper arm being adapted for selective engagement and retrieval of articles from a station proximate the gripper arm in timed relationship with a machine cycle according to which said insertion machine operates, said machine being operable at a variable rate of machine cycles per unit time, said gripper arm combination comprising:

gripper arm housing means having a distal end and a proximal end;

means at the proximal end of said housing for securing said gripper arm to oscillating drive means;

a first jaw member proximate said distal end of said gripper arm housing;

a second jaw member proximate said distal end of said gripper arm housing, said second jaw member being selectively movable with respect to said first jaw member for the engagement of articles therebetween;

actuating means for selectively actuating said second jaw member toward and away from said first jaw member;

linkage means for connecting said actuating means to said movable second jaw member whereby said movable second jaw is selectively moved toward and away from said first jaw member in response to said actuating means; and, control means for controlling the actuating means so that the selective enablement and disablement of said actuating means is dependent upon said machine cycle rate, said control means comprising:

first sensor means for determining said machine cycle rate and for generating encoder pulses related thereto;

second sensor means for determining when during each machine cycle said actuating means should undergo a transition to be selectively enabled or disabled;

clocking means for generating clock pulses having a predetermined frequency; and, means for determining, after said seccond sensor means has indicated that said actuating means should undergo a transition, a point in time at which the number of encoder pulses has a predetermined relationship to the number of clock pulses being generated and for communicating said determination of said point in time to said actuating means.

4. The apparatus of claim 1, wherein said means for determining said point in time further comprises:

first counter means for counting the number of clock pulses occurring between consecutive encoder pulses;

second counter means for counting the number of encoder pulses occurring after said second sensor means has indicated that said actuating means should undergo a transition;

comparison means for comparing the count of said first counter means and the count of said second counter means and for generating a signal indicative of said comparison;

multivibrator means connected to said comparison means and adapted to generate a signal whenever said predetermined relationship is found to exist.

5. A method of operating an insertion machine of a type wherein an insert track is indexed past a plurality of insert stations, said plurality of insert stations each having gripper arm means associated therewith for engaging an insert at said station and for releasing said insert whereby said insert is deposited on said insert track, said method comprising the steps of:

sensing a point in a machine cycle of said insertion machine at which said plurality of gripper jaws should release inserts engaged thereby;

actuating said gripper arms to release their inserts onto said insert track at an actuation time related to said sensed point in said machine cycle;

determining for each of said insert stations whether said actuation results in a proper placement of said inserts on said insert track;

changing the relationship of said actuation time with respect to said point in said machine cycle for individual ones of said insert stations whereat placement of said inserts on said insert track was not proper, whereby said changed relationship results in proper placement of said inserts from said individual ones of said insert stations on said insert track.

6. A method of operating an insertion machine of a type wherein an insert track of adjustable width is indexed past a plurality of insert stations, said plurality of insert stations each having gripper arm means associated therewith for engaging an insert at said station and for releasing said insert whereby said insert is deposited on said insert track, said method comprising the steps of:

loading said plurality of insert stations with inserts;

adjusting the width of said insert track to take into consideration the size of the largest of said inserts at said insert stations;

determining for at least said insert station whereat said largest of said inserts is stored whether an existing relationship between an insert actuation release time and a sensed release time results in the proper placement of said largest insert on said insert track, said sensed released time corresponding to a periodically occurring point in a machine cycle of said insertion machine; and, changing the relationship of said actuation release time with respect to said sensed release time for at least said insert station whereat said largest of said inserts is stored, whereby said changed relationship results in the proper placement of at least said largest of said inserts on said insert track.

7. The method of claim 6, wherein said relationship of said actuation release time with respect to said sensed release time is uniformly changed for all insert stations.

8. The method of claim 7, further comprising the steps of:

determining for each of said insert stations whether said change in said relationship of said actuation release time with respect to said sensed release time results in a proper placement of each of said inserts on said insert track;

further changing the relationship of said actuation release time with respect to said sensed release time for individual ones of said insert stations whereby said further changed relationship results in better placement of said inserts from said individual ones of said insert stations on said insert track.

9. An insertion machine of a type wherein an insert track of adjustable width is indexed past a plurality of insert stations, said plurality of insert stations each having gripper arm means associated therewith for engaging an insert at said station and for releasing said insert whereby said insert is deposited on said insert track, said machine comprising:

means for adjusting the width of said insert track to take into consideration the size of the largest of said inserts at said insert stations; and, means for changing an existing relationship between an insert actuation release time and a sensed release time for at least an insert station whereat said largest of said inserts is stored, said sensed release time corresponding to a periodically occurring point in a machine cycle of said insertion machine, whereby said changed relationship results in the proper placement of at least said largest of said inserts on said insert track.

10. The apparatus of claim 9, wherein said relationship of said actuation release time with respect to said sensed release time is uniformly changed for all insert stations.

11. The method of claim 10, further comprising:

means for further changing the relationship of said actuation release time with respect to said sensed released time for individual ones of said insert stations whereby said further changed relationship results in better placement of said inserts from said individual ones of said insert stations on said insert track.

12. An insertion machine comprising:

a plurality of insert stations whereat supplies of insert material are at least temporarily stored:

an insert track which is indexed along said plurality of insert stations for the transport of inserts deposited thereon;

gripper arm means associated with a plurality of insert stations, said gripper arm means each comprising:

a first jaw member;

a second jaw member, said second jaw member being selectively movable with respect to said first jaw member for the engagement of insert material therebetween; and, means for selectively actuating said first and second jaw members to a first position whereby insert material is engageable between said jaws and to a second position whereby insert material is released from between said jaws and deposited on said insert track;

means for controlling said plurality of actuating means whereby the timing of the actuation of each of said gripper arms for the release of insert material is controllable, said control means including master presettable timing means whereby for said plurality of gripper arms there is provided a uniform time release component which is related to a predetermined input value.

13. An insertion machine comprising:

a plurality of insert stations whereat supplies of insert material are at least temporarily stored;

an insert track which is indexed along said plurality of insert stations for the transport of inserts deposited thereon;

gripper arm means associated with a plurality of insert stations, said gripper arm means each comprising:

a first jaw member;

a second jaw member, said second jaw member being selectively movable with respect to said first jaw member for the engagement of insert material therebetween; and, means for selectively actuating said first and second jaw members to a first position whereby insert material is engageable between said jaws and to a second position whereby insert material is released from between said jaws and deposited on said insert track;

means for controlling said plurality of actuating means whereby the timing action of each of said gripper arms for the release of insert material is controllable, said control means including a plurality of station presettable timing means whereby for each of said gripper arms there is provided an independent time component which is related to a characteristic of insert material at its associated insert station as indicated by a corresponding predetermined input value.

* * * * *